US010525583B2

(12) United States Patent
Gorman et al.

(10) Patent No.: US 10,525,583 B2
(45) Date of Patent: Jan. 7, 2020

(54) TOOL BIT STORAGE AND RETRIEVAL DEVICE

(71) Applicants: Steven F. Gorman, Arlington, VA (US); Douglas J. Gorman, Cumming, GA (US)

(72) Inventors: Steven F. Gorman, Arlington, VA (US); Douglas J. Gorman, Cumming, GA (US)

( * ) Notice: Subject to any disclaimer, the term of this patent is extended or adjusted under 35 U.S.C. 154(b) by 264 days.

(21) Appl. No.: 15/439,766

(22) Filed: Feb. 22, 2017

(65) Prior Publication Data

US 2017/0239807 A1 Aug. 24, 2017

Related U.S. Application Data

(60) Provisional application No. 62/298,202, filed on Feb. 22, 2016.

(51) Int. Cl.

| | |
|---|---|
| ***B25G 1/08*** | (2006.01) |
| ***B25B 23/16*** | (2006.01) |
| ***B25H 3/00*** | (2006.01) |
| ***B65D 85/20*** | (2006.01) |

(52) U.S. Cl.

CPC ..... *B25G 1/085* (2013.01); *B25B 23/16* (2013.01); *B25H 3/003* (2013.01); *B65D 85/20* (2013.01)

(58) Field of Classification Search

CPC ..... B25B 23/16; B25H 3/003; B25H 3/026; B25G 1/085; B25G 1/08; B23B 39/00; B65D 83/00; B65D 85/20; B65D 85/28

USPC ..... 206/379, 372; 211/60.1, 69, 69.1, 70.6

See application file for complete search history.

(56) References Cited

U.S. PATENT DOCUMENTS

| | | | | |
|---|---|---|---|---|
| 3,072,244 A * | 1/1963 | Smith | ..... | B65D 83/02 206/379 |
| 4,434,828 A | 3/1984 | Trincia | | |
| 4,572,038 A | 2/1986 | Graham | | |
| 5,265,504 A | 11/1993 | Fruhm | | |

(Continued)

FOREIGN PATENT DOCUMENTS

| | | |
|---|---|---|
| DE | 102011116422 A1 | 4/2013 |
| EP | 1595655 A1 | 11/2005 |

(Continued)

OTHER PUBLICATIONS

Schandelmaler, Translation of EP2698231A2 reference, Feb. 19, 2014, EPO, pp. 1-13 (Year: 2014).*

(Continued)

*Primary Examiner* — Bryon P Gehman

(74) *Attorney, Agent, or Firm* — Mark Malek; Paul J. Ditmyer; Widerman Malek, PL

(57) ABSTRACT

A tool bit storage and retrieval device includes a housing, a caddy configured to slideably engage an interior of the housing and to removeably receive a plurality of tool bits, and a magnet affixed to the caddy and configured to attract the plurality of tool bits. The caddy is moveable between an open position and a closed position. The closed position is defined by the caddy being substantially contained by the housing. The open position is defined by the caddy being translated outwardly from the housing. The plurality of tool bits are moveable between a first position when the caddy is in the open position, and a second position when the caddy is in the closed position.

6 Claims, 19 Drawing Sheets

(56) References Cited

U.S. PATENT DOCUMENTS

| | | | | |
|---|---|---|---|---|
| 5,435,979 | A * | 7/1995 | Miller | A61C 3/04 211/60.1 |
| 5,675,866 | A | 10/1997 | Tseng | |
| 5,749,271 | A | 5/1998 | Liu | |
| 5,799,552 | A | 9/1998 | Curtis | |
| 5,836,446 | A * | 11/1998 | Varnom | B25H 3/026 211/70.6 |
| 5,868,251 | A | 2/1999 | Lin | |
| 5,896,606 | A | 4/1999 | Huang | |
| 5,924,568 | A * | 7/1999 | Zajonc | B25H 3/026 206/372 |
| 6,029,549 | A | 2/2000 | Baker | |
| 6,032,332 | A | 3/2000 | Lin | |
| 6,050,158 | A | 4/2000 | Cassutti et al. | |
| 6,173,467 | B1 | 1/2001 | Chou | |
| 6,209,428 | B1 | 4/2001 | Anderson et al. | |
| 6,293,173 | B1 | 9/2001 | Rowlay | |
| 6,374,711 | B2 | 4/2002 | Anderson | |
| 6,502,484 | B2 | 1/2003 | Pao-Hsi | |
| 6,510,768 | B2 | 1/2003 | Fruhm | |
| 6,530,098 | B1 | 3/2003 | Gringer et al. | |
| 6,601,483 | B2 | 8/2003 | Wannop | |
| 6,629,478 | B2 | 10/2003 | Kozak | |
| 6,739,226 | B2 | 5/2004 | Beauchamp | |
| 6,742,421 | B1 | 6/2004 | Chen | |
| 6,761,095 | B2 | 7/2004 | Beauchamp | |
| 6,851,344 | B1 | 2/2005 | Wade | |
| 6,968,760 | B2 | 11/2005 | Hu | |
| 7,039,975 | B1 | 5/2006 | Liao | |
| 7,073,417 | B2 | 7/2006 | Beauchamp | |
| 7,086,314 | B2 | 8/2006 | Wannop | |
| 7,258,046 | B2 | 8/2007 | Fruhm | |
| 7,293,484 | B2 | 11/2007 | Liu | |
| 7,374,042 | B2 * | 5/2008 | Liu | B25H 3/003 206/372 |
| 7,409,894 | B1 | 8/2008 | Valentine | |
| 7,523,689 | B2 | 4/2009 | Lin | |
| 8,162,363 | B2 | 4/2012 | Wang | |
| 8,453,543 | B2 | 6/2013 | Floyd | |
| 8,534,166 | B2 | 9/2013 | Hsu | |
| 8,561,507 | B2 | 10/2013 | Huang | |
| 8,590,432 | B2 | 11/2013 | Wang | |
| 8,783,138 | B2 | 7/2014 | Johnson | |
| 8,833,214 | B2 | 9/2014 | Wang | |
| 8,869,657 | B2 | 10/2014 | Matar | |
| 8,869,662 | B2 | 10/2014 | Kozak | |
| 9,221,167 | B2 | 12/2015 | Sun | |
| 10,076,835 | B2 * | 9/2018 | Snook | B25G 1/085 |
| 10,442,074 | B2 * | 10/2019 | Fulbright | B25G 1/085 |
| 2003/0180105 | A1 | 9/2003 | Hsiao | |
| 2004/0065178 | A1 | 4/2004 | Anderson et al. | |
| 2005/0249564 | A1 * | 11/2005 | Van Bergen | B25F 5/026 408/241 R |
| 2007/0289418 | A1 * | 12/2007 | Rodgers | B25F 1/04 81/439 |
| 2009/0071299 | A1 * | 3/2009 | Lin | B25B 13/461 81/177.4 |
| 2010/0116104 | A1 | 5/2010 | Hung | |
| 2010/0229699 | A1 | 9/2010 | Huang | |
| 2010/0288087 | A1 | 11/2010 | Lai | |
| 2011/0216528 | A1 | 9/2011 | Hung | |

FOREIGN PATENT DOCUMENTS

| | | | | |
|---|---|---|---|---|
| EP | 2698231 A2 * | 2/2014 | | B25G 1/085 |
| EP | 2698231 A2 | 2/2014 | | |

OTHER PUBLICATIONS

EPO, "International Search Report for related International Application PCT/US2017/018982 filed on Feb. 22, 2016" dated Jun. 8, 2017 (5 Pages).

EPO, "Written Opinion for related International Application PCT/US2017/018982 filed on Feb. 22, 2016" dated Jun. 8, 2017 (8 Pages).

* cited by examiner

TOOL BIT STORAGE AND RETRIEVAL DEVICE

RELATED APPLICATIONS

This application claims the benefit under 35 U.S.C. § 119(e) of U.S. Provisional Patent Application Ser. No. 62/298,202 filed on Feb. 22, 2016 and titled Angled Tool Bit Storage and Retrieval Device, the entire content(s) of which is incorporated herein by reference.

FIELD OF THE INVENTION

The present invention relates to an apparatus and associated systems and methods for tool bit storage and retrieval.

BACKGROUND

Tool bit storage and retrieval has historically been problematic and has included a variety of inadequate solutions that have been mass marketed over the years. Some approaches to tool bit storage and retrieval have included tool belts with straps that hold the tool bits into place. However, the holding straps often are not properly sized to accommodate the tool bits. These methods often hold the tool bits juxtaposed in a linear configuration that presses the tool bits vertically against the belt. Not only does this method make it difficult to retrieve the tool bits, but it makes it difficult to replace the tool bits once used. Other approaches to tool bit storage and retrieval include storage devices with a plurality of resilient plastic clips to clamp the bodies of the tool bits and thereby hold the tool bits in place. However, these approaches are inconvenient in that substantial force is required to push the bits into the resilient clips and precise placement of the tool bit is required to properly engage the resilient clip when storing a tool bit into the storage device. Furthermore, the resilient plastic clips are often thin and delicate and therefore can break off, preventing storage of tool bits at the position of the broken resilient clip.

These methods do not provide enough space between individual tool bits. Furthermore, they do not provide enough space between the tool bit and the belt or storage device itself and the tool bits are not angled away from the belt or storage device to facilitate easy handling. Therefore, it is difficult for a user to grab the tool bits with their fingers without exerting considerable effort. Similarly, considerable effort is needed to replace the tool bits on the belt or storage device after use. Thus, tool bits are often lost after use.

Other tool bit storage and retrieval devices have been developed in an attempt to overcome some of the aforementioned issues. However, these developments suffer from structural inadequacies that do not facilitate quick and easy retrieval and replacement of the tool bits. Therefore, there is a need in the art for a tool bit storage and retrieval device that alleviates these issues.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, the present invention advantageously orients the tool bits at a splayed angle leaving room for a user's fingers to grasp and remove the tool bits. The tool bits can be replaced with much greater ease because of the use of magnets. Rather than awkwardly placing a bit into a device, the present invention advantageously allows a user to place a tool bit near a magnet that will guide the tool bit into position by magnetic attraction.

Additionally, the mechanics of the present invention advantageously provide for much smoother motion than those found in the art. The present invention provides a firm and consistent resistance when removing a bit from a magnet. Furthermore, the present invention may provide a sharp click when a bit contacts the magnet when placed back into storage. Further, the present invention advantageously provides a sturdy mechanical motion when portions of the tool bit storage devices are transitioned from an open splayed position to a closed storage position. The use of magnets both holds the tool bits in place as well as biases them to the splayed open position when being used. The magnetic attraction with the housing of the present invention also provides a quick and mechanical snap shut to the device when being closed. None of these benefits are found in the prior art.

These and other objects, features and advantages are provided by a tool bit storage and retrieval device that includes a housing, a caddy configured to slidably engage an interior of the housing and to removeably receive a plurality of tool bits, and at least one magnet affixed to the caddy and configured to attract the plurality of tool bits. The caddy may be moveable between an open position and a closed position. The closed position is defined as the caddy being substantially contained by the housing. The open position is defined as the caddy being translated outwardly from the housing. The plurality of tool bits are configured in a first position when the caddy is in the open position, and in a second position when the caddy is in the closed position.

In the first position the plurality of tool bits may be splayed relative to a longitudinal axis of the caddy. The second position may be defined as one in which the posture of the plurality of tool bits is restricted by the housing interior. Additionally, the housing interior may be structured to store the plurality of tool bits therein.

At least one magnet may be configured to hold an end of the plurality of tool bits. Furthermore, the at least one magnet may be positioned at an angle relative to a longitudinal axis of the caddy and may be structured to splay the plurality of tool bits away from the longitudinal axis of the caddy.

In some embodiments, the at least one magnet may form a slanted base portion. In this embodiment, the slanted base portion may be structured to splay the plurality of tool bits away from a longitudinal axis of the caddy when the caddy is in the open position.

The tool bit storage and retrieval device may be integrally formed with at least a portion of a tool structured to be operable with a tool bit. For instance, the tool bit storage and retrieval device may be integrally formed with one of a handle of a t-handle driver and a handle of a screwdriver.

In some embodiments, the at least one magnet may be a plurality of magnets positioned around a topside of a caddy base. Furthermore, the plurality of magnets may be positioned within a plurality of bores on the topside of the caddy base.

Another embodiment of the tool bit storage and retrieval device may include a housing, an engagement member including an elongate shaft with a shaft first end, defined as a shaft head, and a shaft body. It may further include a caddy with a caddy base that has a topside and a bottom side. The caddy may include an engagement aperture located in the caddy base structured to receive the engagement member therethrough. Furthermore, the caddy may include at least one magnet on the caddy base structured to attract a plurality of tool bits as well as a caddy cap.

In this embodiment, the shaft head of the engagement member may be larger in diameter than the engagement aperture at the topside of the caddy base. The shaft body may be positioned through the engagement aperture and structured to slide the caddy within the housing between limits provided by the shaft head and the caddy cap. In this embodiment, the caddy may be in a fully open position when the shaft head is in contact with the caddy base topside. The caddy may be in a closed position when the caddy cap is in contact with the housing top. Furthermore, the at least one magnet may be structured to splay the plurality of tool bits away from the longitudinal axis of the caddy when the caddy is oriented in an open position. Additionally, an interior of the housing may be structured to restrict the posture of the plurality of tool bits and store the plurality of tool bits when the caddy is oriented in a closed position.

The surface of the at least one magnet may be positioned at an angle relative to a longitudinal axis of the caddy and configured to hold an end of the plurality of tool bits. Furthermore, this embodiment may include an attractor member whereby the attractor member may be metal and may be structured to bias the caddy in the closed position by the at least one magnet's attracting force propagating through the bottom side of the caddy base. The attractor member may be positioned in magnetic communication with the bottom side of the caddy base.

In this embodiment, a portion of the engagement member may be affixed to an interior portion of the housing. Furthermore, the housing may be one of cylindrical, oval prism, ovoid prism, square prism, rectangular prism and polygonal prism in shape. The housing may include a hollow interior and one enclosed end.

As previously mentioned, some embodiments may be structured to include the at least one magnet as a plurality of magnets positioned around the caddy base. Furthermore, the plurality of magnets may be positioned within a plurality of bores on a topside of the caddy base. In other embodiments, the at least one magnet may be formed as a slanted base portion. The slanted base portion may be structured to orient the at least one magnet at an angle to splay the plurality of tool bits away from a longitudinal axis of the caddy when the caddy is in the open position.

In some embodiments, the caddy may include one of columns that extend from the caddy cap to the caddy base, and ribs. The columns and ribs may be structured to separate individual tool bits within the plurality of tool bits.

Furthermore, the tool bit storage and retrieval device may include a hollow caddy axle extending medially from the caddy base to the caddy cap. The hollow caddy axle may be structured to receive the engagement member therein.

In all embodiments, the tool bit storage and retrieval device may be integrally formed with at least a portion of a tool structured to be operable with a tool bit.

DETAILED DESCRIPTION OF THE INVENTION

Figure 1:
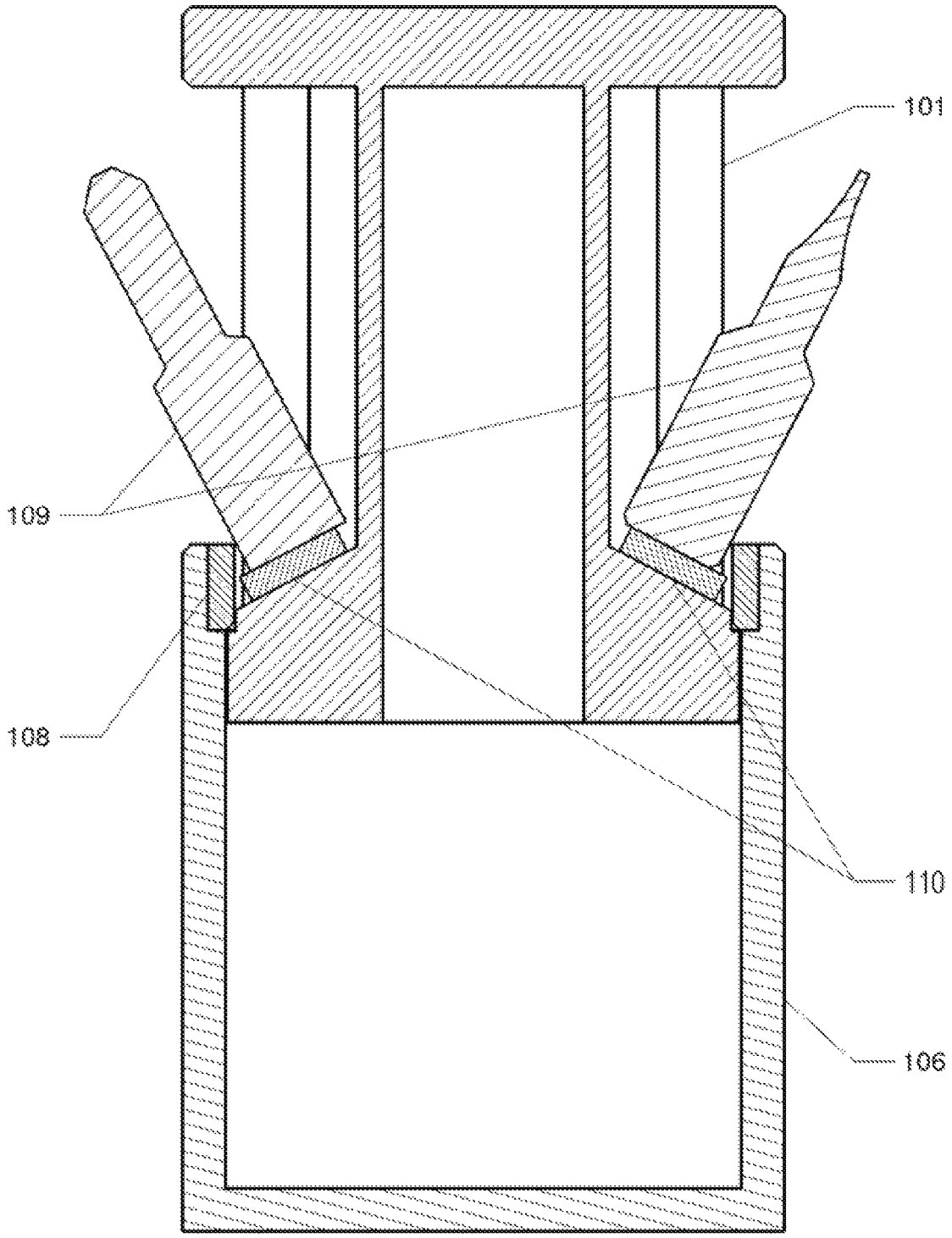
FIG. 1 is a cross-sectioned view of a tool bit storage and retrieval device in an open position according to an embodiment of the present invention taken through line 7A-A of FIG. 7.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

An embodiment of the invention, as shown and described by the various figures and accompanying text, provides a tool bit storage and retrieval device 100. The tool bit storage and retrieval device includes a caddy 101 configured to store a plurality of tool bits 109 when enclosed by a housing 106 and configured to splay the tool bits at an easily accessible angle when the caddy is placed in an open position and extended wholly or partially outside of the housing.

Referring to FIGS. 1-9, a first embodiment of the tool bit storage and retrieval device 100 is described. Referring specifically to FIGS. 1-3 and FIG. 6, the tool bit storage and retrieval device 100 according to the present embodiment may include a caddy 101 configured to store and splay tool bits 109. The caddy 101 may include a caddy base 102, base surfaces 115, magnets 110, longitudinal members 103, longitudinal recesses 104, a base lip 111, and a caddy cap 105. The caddy base 102 may be circular in shape, but those skilled in the art will appreciate that the caddy base may have any shape while still accomplishing the goals, features and advantages of the present invention. A first surface of the caddy base 102, in some embodiments, defined as the base bottom, may be flat and circular. An opposing surface of the caddy base 102, defined as the base top, may be multi-leveled wherein there may be a first outer boundary and a smaller second inner boundary. The base lip 111 may be a ring-shaped surface located on the base top adjacent to the outer boundary that equals the circumference of the base bottom. The smaller second inner boundary circumscribes the caddy center 116. The caddy center 116 is defined as a cylindrical middle portion of the caddy 101 that extends from the second inner boundary of the caddy base 102 to the caddy cap 105. The second inner boundary may be elevated above the base lip 111 if viewing the caddy 101 from an orientation where the caddy base 102 is the bottom and the caddy cap 105 is the top.

Figure 3:
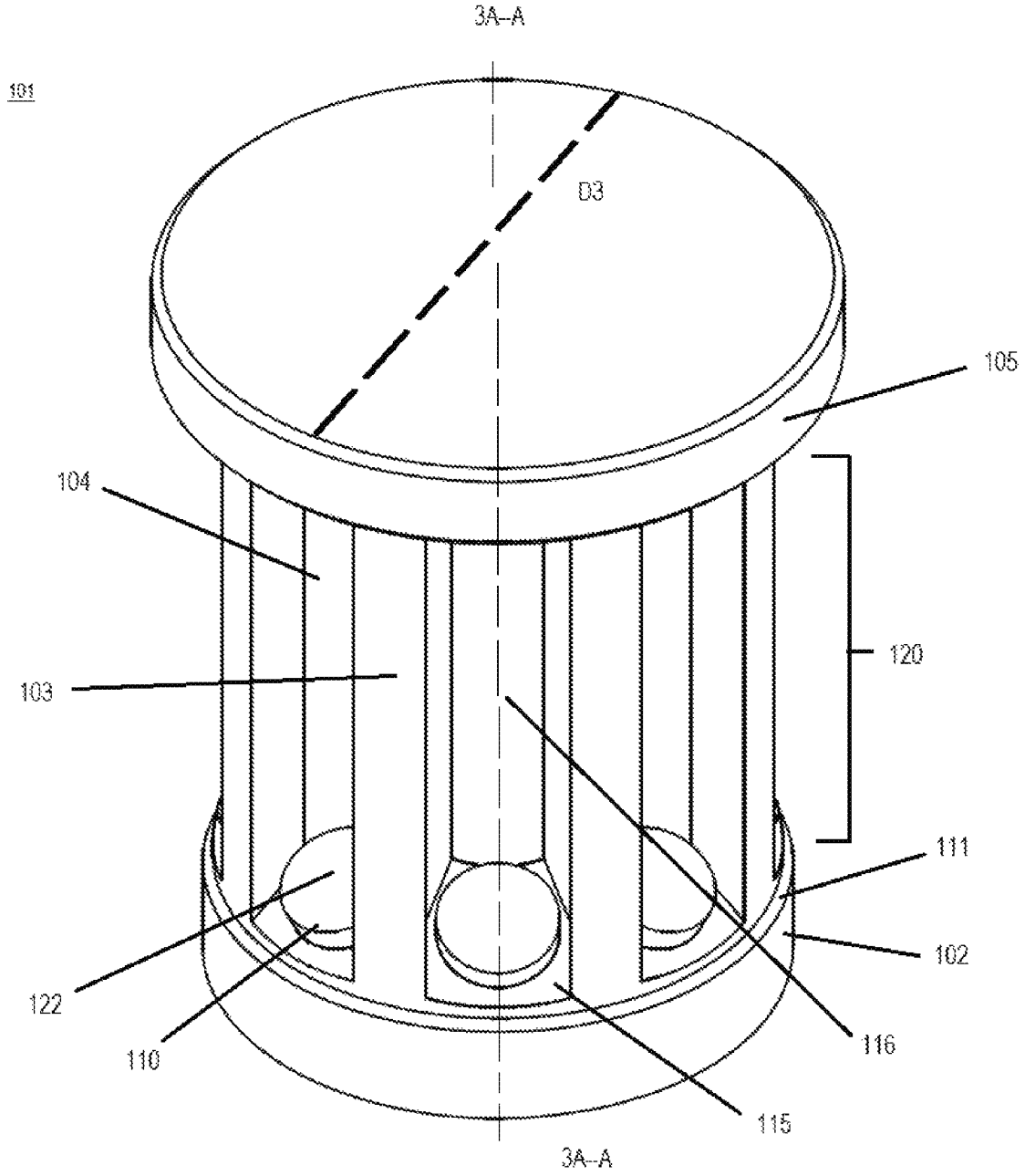
FIG. 3 is a side perspective view of a caddy of the tool bit storage and retrieval device illustrated in FIG. 1.
Figure 8:
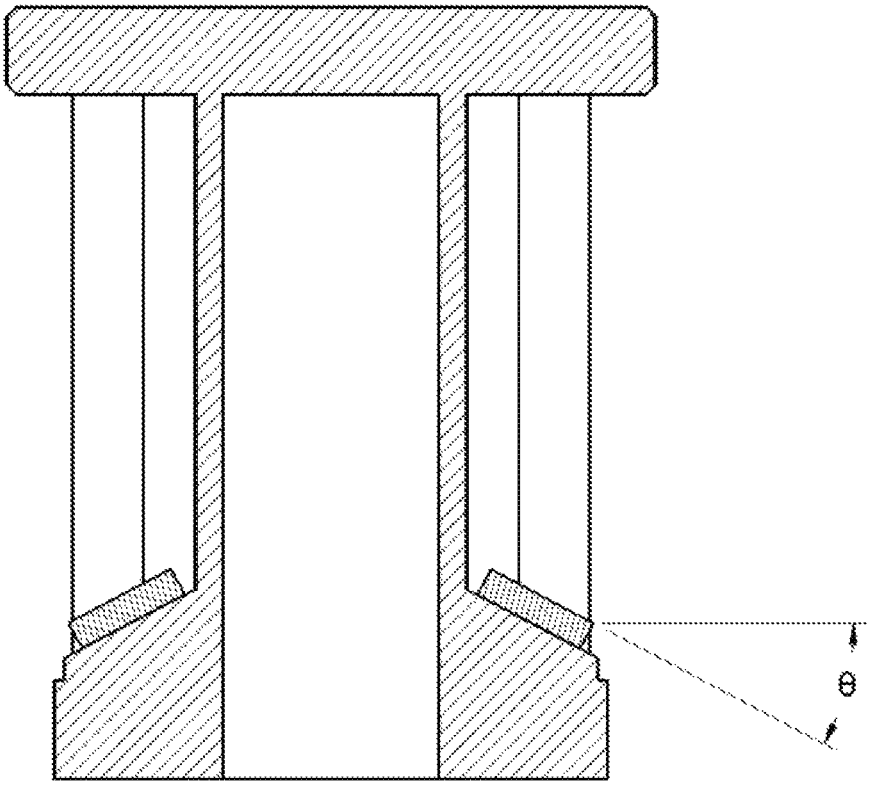
FIG. 8 is a cross-sectioned side view of the caddy illustrated in FIG. 3 taken through line 3A-A.

Referring now to FIG. 3 and FIG. 8, additional features of the caddy 101 of the tool bit storage and retrieval device 100 are now described in greater detail. The base surfaces 115 may extend from the caddy center 116 at a first end to the base lip 111 at the second end. In some embodiments, the base surfaces 115 may be oriented at a 30-degree angle between the base lip 111 and the caddy center 116 thereby creating a slanted surface on which the magnets may be secured. However, any angle which facilitates easy access to the tool bits 109 is contemplated to be within the scope herein. Furthermore, in some embodiments the base surfaces 115 may not be angled, but the magnets themselves may be angled.

The magnets 110 may be attached to the surface of the base surfaces 115. In the depicted embodiment, magnets are cylindrical, however, any shape that may be sized to fit the surface of the base surfaces 115 and provide a planar top surface is contemplated to be within the scope herein, including, but not limited to, any solid prism, wedge-shaped, stepped cylinder-shaped, truncated cone-shaped, or the like. The base surfaces 115 may be oriented so that the holding surfaces 122 of the magnets 110 form greater than a 90-degree angle with the caddy center 116. This orientation is defined as facing away from the caddy center 116. This orientation therefore situates the top surface of each magnet 110 to face away from the caddy center 116 as well. In the depicted embodiment, the base surfaces 115 may be slanted planar surfaces, however the base surfaces 115 may be any shape or angle which allows magnets 110 to be mounted such that the holding surface 122 of the magnet 110 is slanted away from the caddy center 116. Referring to FIG. 8, the slant of the holding surface 122 of the magnet 110 forms an angle θ between the holding surface 122 and a normal to a longitudinal axis of the caddy 101. For purposes of this application, longitudinal shall refer to extending in the direction of length and axis shall define a central linear position. This angle may be approximately 30 degrees or any angle which facilitates easy access to the tool bits 109 ranging between 0 and 90 degrees. A series of longitudinal members 103 may connect to the caddy base 102 at a first end, extending distally therefrom and connect to the caddy cap 105 at a second end. The longitudinal members 103 may define longitudinal recesses 104 around the perimeter of the caddy 101. The longitudinal members 103 may define the longitudinal recesses 104 as polygonal walls configured to facilitate the placement of tool bits 109 therein.

The caddy cap 105 may form a circular second end of the caddy 101 that opposes the first end comprised of the caddy base 102. The caddy 101 itself may be generally cylindrical in shape, however, the circular second end, which may include the caddy cap 105, may have a diameter D3 larger than the diameter of the circular first end, which may include the caddy base 102.

Figure 4:
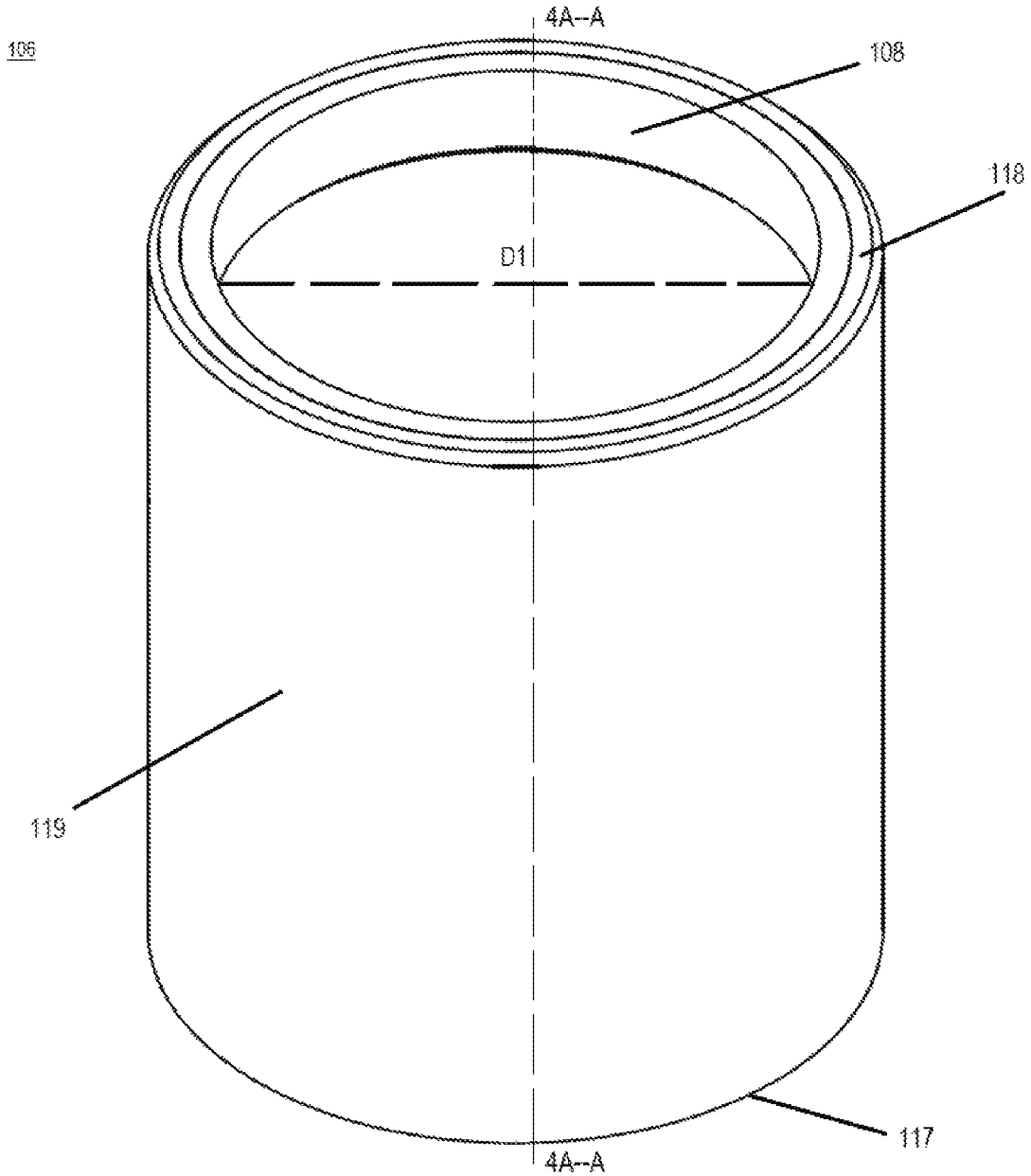
FIG. 4 is a side perspective view of a housing of the tool bit storage and retrieval device illustrated in FIG. 1.
Figure 9:
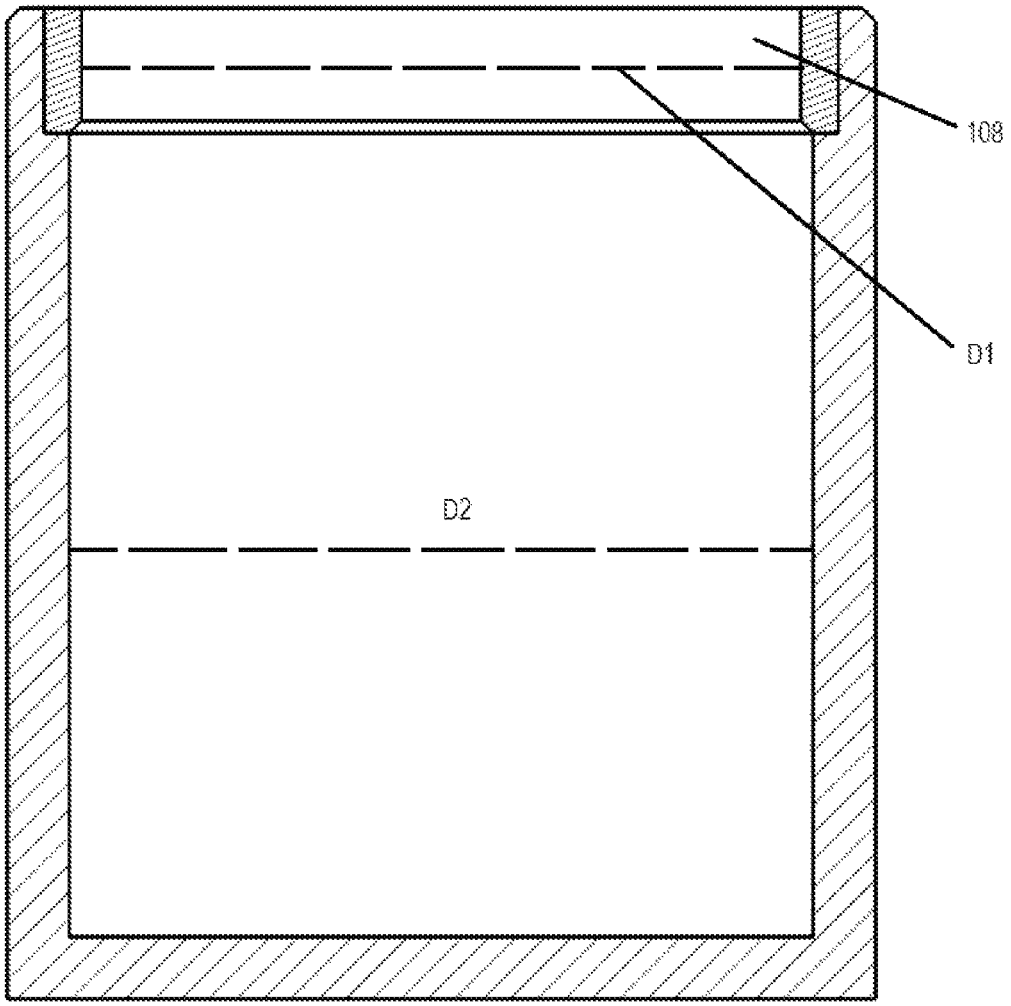
FIG. 9 is a cross-sectioned side view of the housing illustrated in FIG. 4 illustrating a housing inner diameter and a stop ring inner diameter taken through line 4A-A.

Referring now additionally to FIGS. 4 and 9, the tool bit storage and retrieval device 100 may include a housing 106. The housing 106 may be cylindrical in shape with a hollow interior. The housing may include a first end defined as the housing bottom 117, a second end defined as the housing top 118, and a housing body 119 located medially there between. The housing 106 top may include a cross-sectioned circular aperture defined as an open end. Circumscribing the interior open end of the housing top 118 may be a stop ring 108. In some embodiments, the stop ring 108 may be chamfered on one side to facilitate tool bits 109 sliding over the stop ring 108. The stop ring may be configured to narrow the housing top 118 diameter D1 so that the diameter D1 is smaller than the housing body 119 inner diameter D2. Moreover, the housing top 118 fitted with the stop ring 108 may be configured to have a diameter D1 smaller than the diameter of the caddy 101 base lip 111 yet larger than the diameter of the caddy body 120.

Similarly, the housing top 118 fitted with the stop ring 108 may be configured to have a diameter D1 smaller than the diameter D3 of the caddy cap 105. Because the caddy base 102 below the base lip 111 may have a diameter larger than the inner diameter of the stop ring 108, the stop ring 108 may be assembled into the housing 106 after the caddy base 102 is inserted into the housing 106. The stop ring 108 may be a single solid ring or it may be two or more ring segments which fit together. The stop ring 108 may be assembled with the caddy 101 assembly and around the longitudinal members 103 so that the stop ring 108 may be fixed in place at the top of the housing 106 after the caddy base 102 is inserted into the housing 106. When the housing 106 is assembled over the caddy body 120, the housing 106 may be able to slide distally from the caddy cap 105 until the stop ring 108 comes into contact with the caddy 101 base lip 111. This is defined as the open position. Likewise, the housing 106 may be able to slide distally from the caddy 101 base lip 111 before coming to rest abutting the caddy cap 105. This is defined as the closed position. In some embodiments, when the housing 106 is assembled over the caddy body 120, the caddy 101 may be able to slide outwards from the housing 106 until the housing stop ring 108 comes into contact with the caddy 101 base lip 111. In this embodiment, this may be defined as the open position. Likewise, the caddy 101 may be able to slide distally into the housing 106 from the open position until the caddy cap 105 comes to rest abutting the housing top 118. In this embodiment, this may be defined as the closed position.

Figure 2:
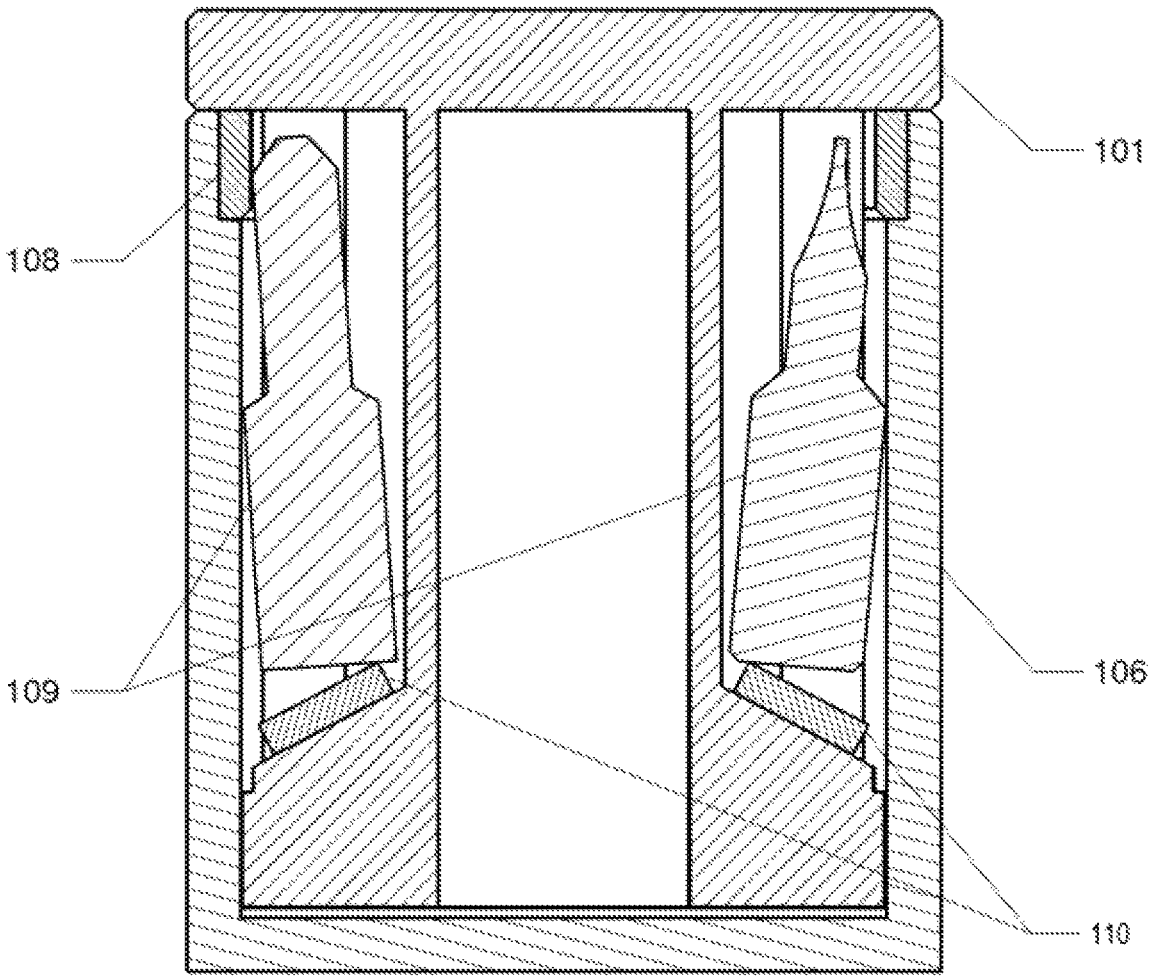
FIG. 2 is a cross-sectioned view of the tool bit storage and retrieval device in a closed position, according to an embodiment of the present invention taken through line 5A-A of FIG. 5.
Figure 5:
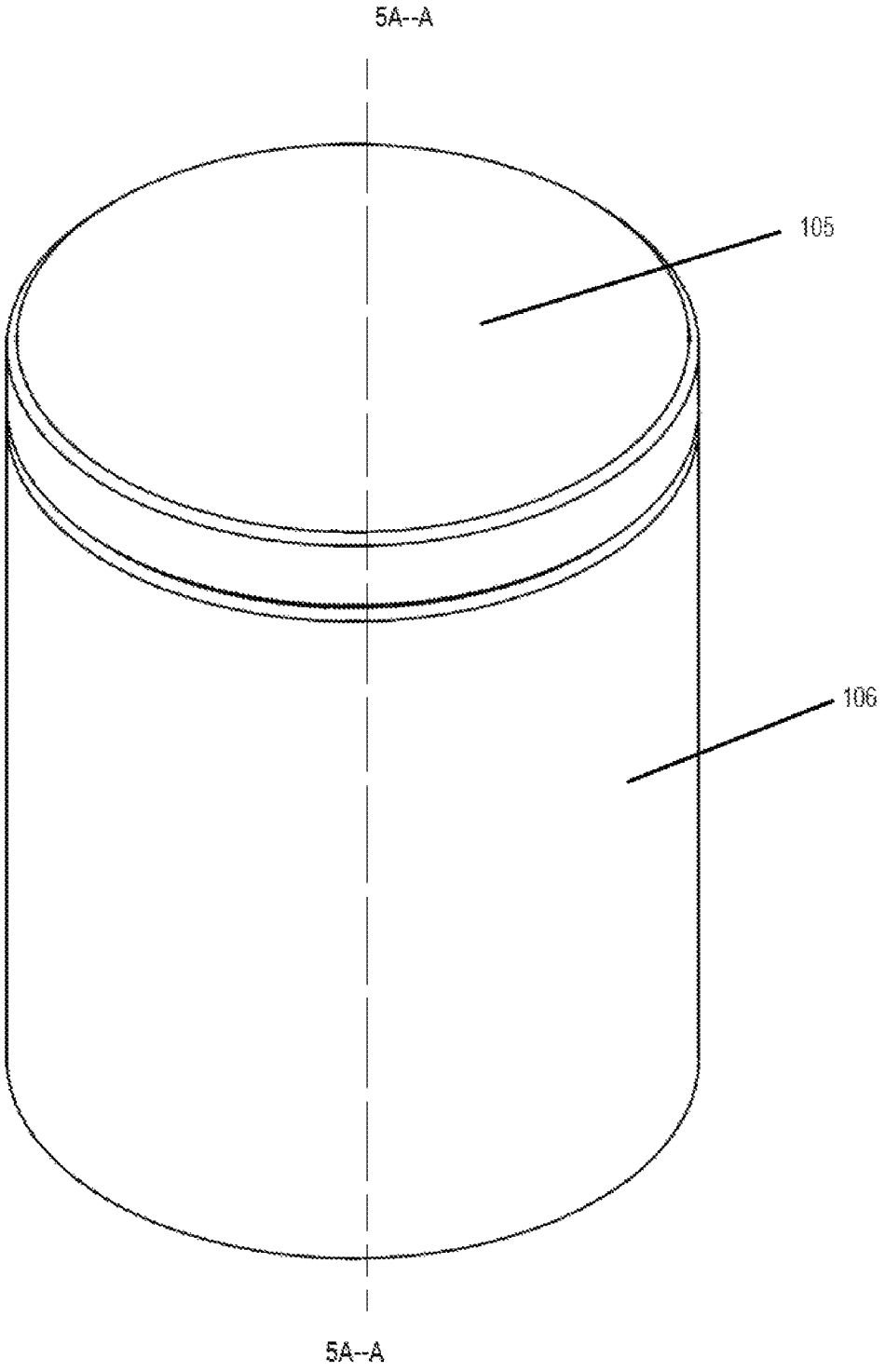
FIG. 5 is a side perspective view of the tool bit storage and retrieval device illustrated in FIG. 1 in the closed position.

Referring now to FIG. 2 and FIG. 5, the tool bit storage and retrieval device 100 is shown with the caddy 101 inserted into the housing 106 in the closed position. The top surface of the housing 106 may serve as a seat for the caddy cap 105, preventing the caddy cap 105 from being inserted into the housing body 119. The caddy cap 105 may be configured to be grasped by a user's hand and adapted to facilitate the sliding of the housing 106 relative to the caddy body 120 thereby transitioning the tool bit storage and retrieval device 100 between open and closed positions. In some embodiments, the caddy cap 105 may be knurled around its outer surfaces to enhance grip. In certain embodiments, the caddy 101 may be movable relative to a fixed housing 106, or some or all of the housing 106 may be movable relative to a fixed caddy 101. In certain embodiments, when in the open position the tool bits 109 may tilt over the housing top 118 or may tilt through an opening or a plurality of openings in the housing 106 wall.

Figure 6:
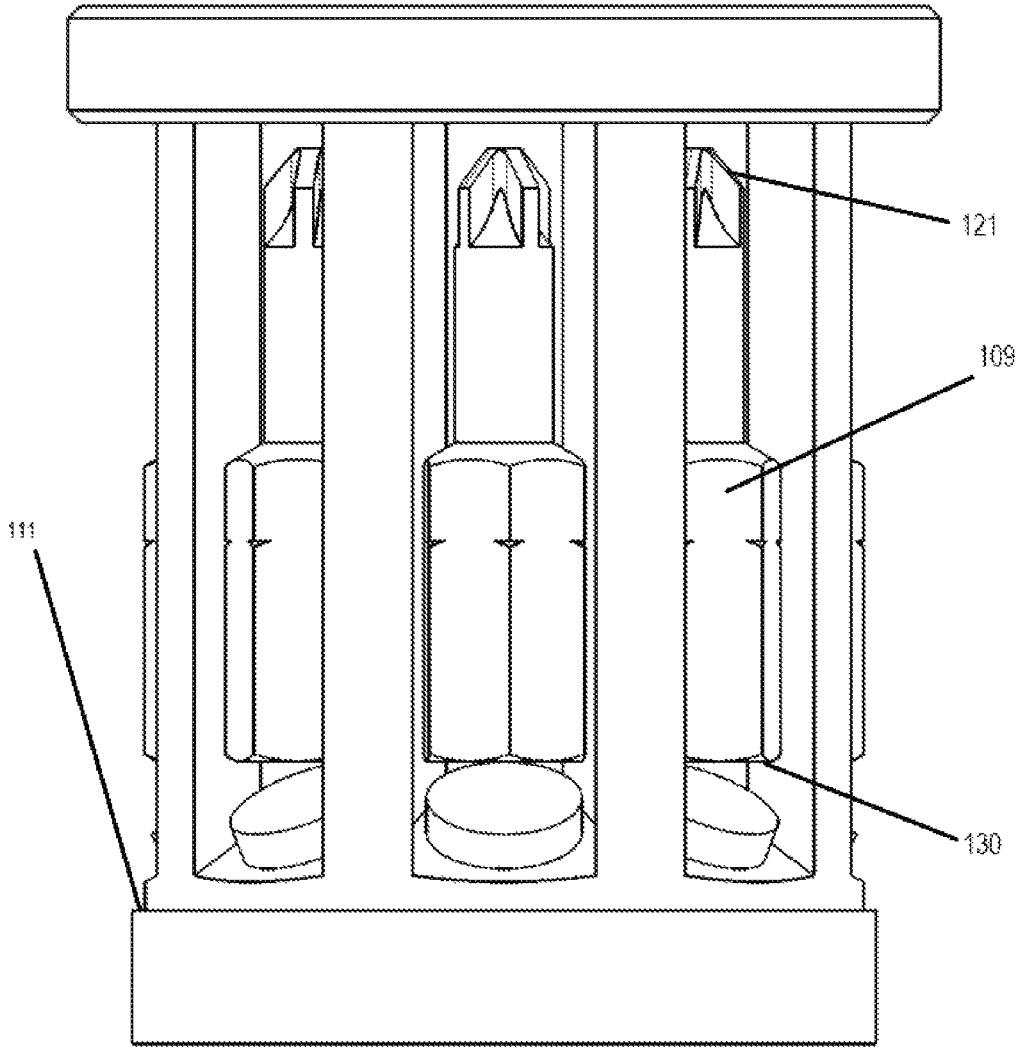
FIG. 6 is a side elevation view of the caddy illustrated in FIG. 3 with tool bits stored thereon.

Referring now to FIG. 6, a side view of the caddy 101 when the tool bit storage and retrieval device 100 is in the closed position is shown. When in the closed position, the tool bits 109 may be constrained by the interior of the housing 106 and aligned within the longitudinal recesses 104 substantially parallel to the caddy center 116. However, the tool bits 109 may lean against the interior wall of the housing 106, and away from the caddy center 116 as depicted in FIG. 2. This slight lean may characterize the substantially parallel posture of the plurality of tool bits 109 relative to the caddy center 116 when in the closed position. When the tool bit storage and retrieval device 100 is in the closed position, the tool bits therein are defined to be in their stored position. As is known in the art, a typical tool bit consists of a flat end 130 that is configured to fit inside a tool, and a utility end 121 that is used to facilitate the turning of a fastener. By way of non-limiting example, a fastener may include a screw or the like. When in the stored position, the flat end 130 of the tool bit 109 may be substantially perpendicular to the caddy center 116 yet misaligned with respect to the magnet 110 so as not to lie level with the holding surface 122 of the magnet 110. In some instances, the flat end 130 of the tool bit 109 may rest upon the upper edge of the holding surface 122 of the magnet 110. This may be a result of the constraining force of the interior walls of the housing 106 overcoming the magnetic force between the holding surface 122 and the flat end 130 that would otherwise leave the two aligned and angled away from the caddy center 116.

Figure 7:
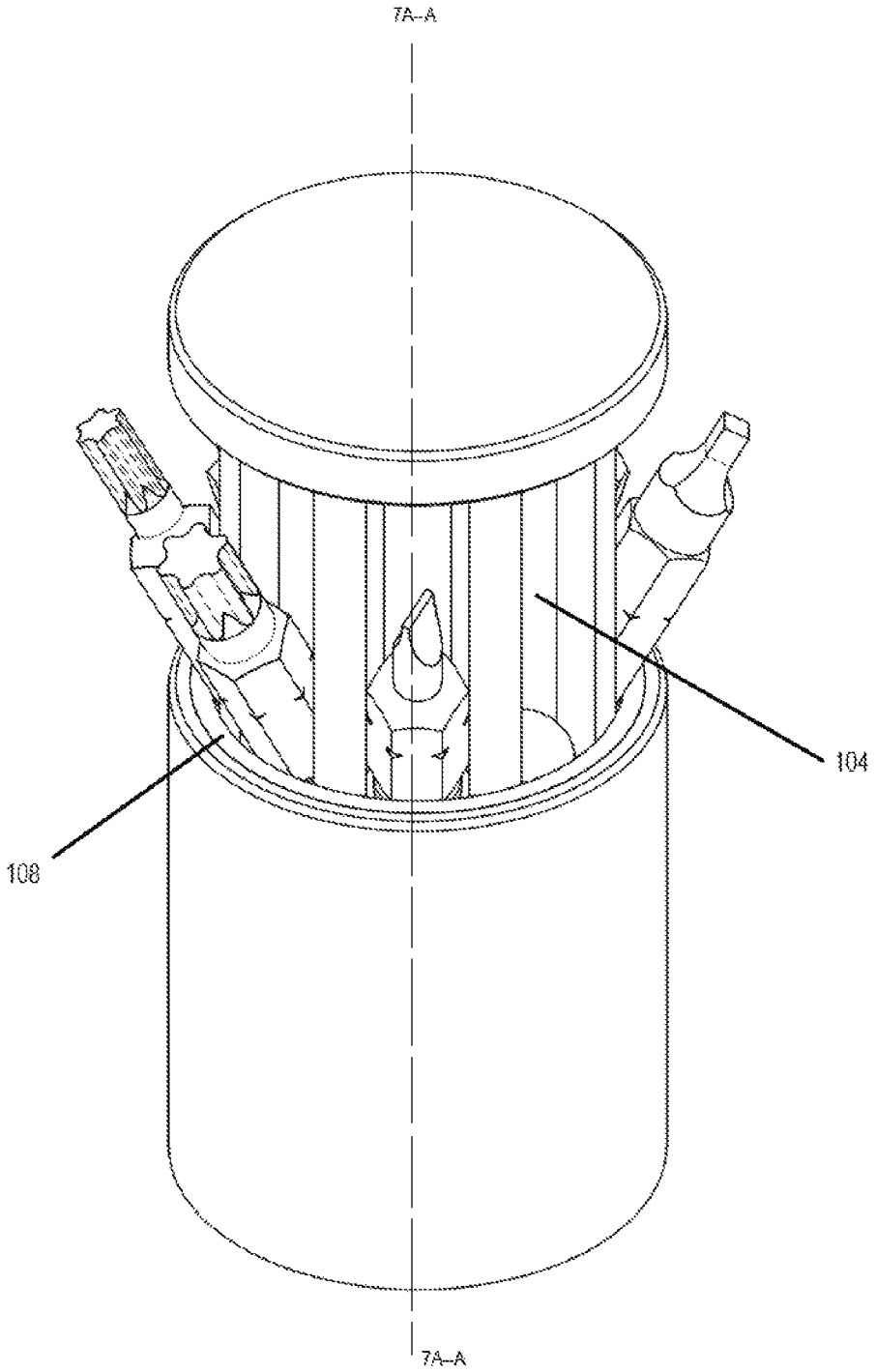
FIG. 7 is a side perspective view of the tool bit storage and retrieval device illustrated in FIG. 1 in the open position.

Referring now to FIG. 1 and FIG. 7, the tool bit storage and retrieval device 100 is shown in the open position. As shown, the housing 106 may slide distal to the caddy cap 105 so that the stop ring 108 may contact the caddy 101 base lip 111. In this position, the interior walls of the housing 106 may not constrain the tool bits 109 in the stored position, thereby allowing magnetic attraction to position the flat end of the tool bit 109 to align substantially level with the holding surface 122 of the magnet 110. When the flat end 130 of the tool bit 109 is aligned substantially level with the holding surface 122 of the magnet 110, the tool bits 109 may be splayed away from the caddy center 116 substantially perpendicular to the holding surface 122 of the magnet 110 and at an angle configured to facilitate a user's removal of the tool bits 109 from the caddy 101. Likewise, each magnet 110 and longitudinal recess 104 may be spaced at a distance around the circumference of the caddy center 116 so as to facilitate a user's ability to remove or replace a tool bit 109 without interference from another tool bit 109 within the caddy 101.

The tool bit storage and retrieval device 100 may be operated by a user grasping the caddy cap 105 with a first hand and grasping the housing body 119 with a second hand. The tool bit storage and retrieval device 100 may be transitioned into an open position when a user pulls the caddy cap 105 in a direction opposite the housing body 119 grasped by the second hand. As the housing body 119 slides outwardly from the caddy cap 105 the constraining force of the housing body 119 may be removed and the flat end 130 of the tool bit 109 may begin to align level with the holding surface 122 of the magnet 110. When the caddy 101 base lip 111 reaches the stop ring 108 the housing body 119 may slide no further outward from the caddy cap 105 and the tool bit storage and retrieval device 100 may be considered to be in the open position.

When in the open position, the tool bits 109 may be splayed around the caddy center 116 so that the utility end 121 of the tool bits 109 may be angled away from the caddy center 116 in a manner configured to facilitate the removal and replacement of the tool bits 109 therein. A user wishing to store a tool bit 109 within the caddy 101 may place the flat end 130 of the tool bit 109 onto the holding surface 122 of the magnet 110, which may allow the attractive force of the magnet 110 to hold the tool bit 109 in place. A user wishing to retrieve a tool bit 109 from the tool bit storage and retrieval device 100 may grasp the tool bit 109 and remove it with enough force to overcome the magnetic attraction between the flat end 130 of the tool bit 109 and the holding surface 122 of the magnet 110.

When the tool bit storage and retrieval device 100 is in the open position, the splayed tool bits 109 may be biased to remain in the splayed position by attraction of the flat ends 130 of tool bits 109 towards the holding surfaces 122 of the magnets 110. In this orientation, the sides of the tool bits 109 are leveraged against the upper portion of the housing 106 thereby biasing the tool bit storage and retrieval device 100 to the open position. It may in turn be biased to remain in the open position until acted upon by enough outside force to overcome the magnetic force splaying the tool bits 109. This outside force may cause the sides of the splayed tool bits 109 to engage the upper inside edge of the stop ring 108 and retract. The tool bit storage and retrieval device 100 may be transitioned from the opened position to a closed position when a user pushes the caddy cap 105 with a first hand toward the housing body 119 grasped by a second hand. The force of the user sliding the two components in this manner may overcome the magnetic attraction aligning the flat end of the tool bit 109 with the holding surface 122 of the magnet 110. This motion may begin to move the tool bits 109 in a manner so as to align them substantially parallel to the caddy center 116. When the housing top 118 reaches the caddy cap 105 and abuts thereto, the contact of the housing top 118 against the caddy cap 105 may prevent the housing 106 from sliding any further and the tool bit storage and retrieval device 100 may come to rest in a closed position. When in the closed position, the tool bits 109 may be aligned substantially parallel with the caddy center 116 and may be constrained within the tool bit storage and retrieval device 100 by the housing 106. When in the closed position, the tool bit storage and retrieval device 100 may allow the tool bits 109 to be stored and transported easily. In some embodiments, the caddy 101 may be rotatable 360 degrees within the housing 106 both in the open and closed position. This facilitates a user's ability to select a desired tool bit 109 without rotating the entire device. By rotating the caddy 101 relative to the housing when the caddy 101 is oriented in the open position, a user may view all tool bits 109 stored within the caddy 101 before selecting the one desired.

In one embodiment, the tool bit storage and retrieval device 100 may be integrated into a screwdriver handle. In such an embodiment, the caddy cap 105 may be located at the end of the screwdriver handle distal the portion of the screwdriver adapted to interact with a screw and the caddy 101 may slide distal to the screwdriver handle.

Another embodiment may include the tool bit storage and retrieval device 100 integrated into one or both ends of the longitudinal handle of a T-handled driver. In such an embodiment, a plurality of tool bits 109 may be stored in each a first and/or a second end of the handle. The tool bit storage and retrieval device 100 at each of the first and second end of the handle may be operated independently. Other embodiments may include the tool bit storage and retrieval device into the body of a power tool or a tool box or into the handle or body of any hand tool.

In certain embodiments, a device may be provided to bias the caddy 101 of the tool bit storage and retrieval device 100 to the closed position. In such an embodiment, to operate, the user may grasp the caddy cap 105 and pull with a force exceeding a threshold force exerted by the biasing device in order to open the caddy 101. The biasing device may include, but is not limited to, a magnet, which may be affixed to the side of the caddy cap 105, proximate to the base lip 111 or to the bottom of the caddy base 102. The magnet may be attracted to another magnet or metallic element fixed within the housing 106 when the caddy 101 is in the closed position. The biasing device may alternatively include a friction fit of a part of the caddy 101 located within the housing 106 when the caddy 101 is in the closed position. The biasing device may also be a snap fit of a part of the caddy 101 within the housing 106 when the caddy 101 is in the closed position. The biasing device may alternatively include a metallic element fixed to the housing 106 that is attracted to the magnets 110 of the caddy 101 when the caddy 101 is in the closed position.

In certain embodiments, a device may be provided to prevent rotation of the caddy 101 within the housing 106. This may be accomplished in a number of ways, including, but not limited to, a tongue in the caddy 101 engaging a groove in the housing 106. The rotation prevention device may include a slot cut in the wall of the housing 106 into which an element fixed to and protruding from the caddy 101 may fit within. The rotation prevention device may include a caddy 101 and housing 106 both having corresponding polygonal perimeters so as to prevent relative rotational translation between the caddy 101 and the housing 106. The rotation prevention device may include a caddy cap 105 polygonal in shape engaging a like-shaped recess at the top of the caddy 101 housing 106. The rotation prevention device may include a single projection or a plurality of projections extending distally from the caddy cap 105 engaging a recess at the top of the housing 106. The rotation prevention device may include a projection extending distally from the housing 106 engaging a recess in the proximate side of the caddy cap 105. The rotation prevention device may include a radial projection from the caddy cap 105 engaging a recess in the housing 106.

In certain embodiments, the caddy cap 105 may be recessed into the housing 106 when the caddy 101 is in the closed position. In such an embodiment, an alternate means for grasping the caddy cap 105 may be provided for the user to extend the caddy 101 distally from the housing 106. For example, there may be a push latch whereby the caddy cap 105 may be pushed into the housing 106 to latch the tool bit storage and retrieval device 100 in the closed position. In order to place the tool bit storage and retrieval device 100 in the open position, the caddy cap 105 may then be pushed again to be released whereby a spring biases the tool bit storage and retrieval device 100 to the open and extended position. Another embodiment may demonstrate a portion of the caddy 101 extending through a slot or cavity in the housing 106, which may be configured to facilitate a user grasping and moving the caddy 101 between the open and closed positions.

In certain embodiments, tool bits 109 may be stored in longitudinal recesses 104 around the perimeter of the caddy center 116. Other embodiments may include a single recess that spans the entire circumference of the caddy center 116 with no separation between tool bits 109. In certain embodiments, individual recesses may be fully separated from each other by solid walls, or the recesses may be largely open to adjacent recesses, with only a partial wall separating the recesses.

The tool bit storage and retrieval device 100 may be made of plastic or metal or composites or a combination of plastics and/or metals and or composites, or of any other suitable material known in the art. In certain embodiments, the tool bit storage and retrieval device 100 may be manufactured using injection molding, die casting, machining, extruding, additive manufacturing, or any other suitable method of manufacturing.

The distance that the caddy 101 may be extended distally from the housing 106 may be limited by one or more embodiments. One embodiment may include a stop ring 108 on the housing 106 with an inner diameter less than the outer diameter of some part of the caddy 101. There also may be an element protruding from the inner surface of the housing 106 contacting some element of the caddy 101 and preventing the caddy 101 moving beyond the point of contact. Another embodiment may include a groove or slot cut into or through the wall of the housing 106, into which a protruding element of the caddy 101 may be inserted, preventing movement of the protruding element of the caddy 101 beyond the termination of the groove or slot. Yet another embodiment may include a flexible tether attached to the bottom of the caddy 101 and to the housing 106 preventing the caddy 101 from moving beyond the point where the tether is fully extended.

In certain embodiments where a housing stop ring 108 is used, the stop ring 108 may be implemented in a variety of ways. In one embodiment, a stop ring 108 may be formed integral to the housing 106. Another embodiment may include a stop ring 108 as a single solid circular ring spanning the entire inner circumference of the housing 106. Another embodiment may include a single partial ring of less than the entire inner circumference of the housing 106 or a single ring spanning the entire circumference with a split that may be opened for assembly. Another embodiment of the stop ring 108 may use multiple arc-shaped pieces which encircle the inner circumference of the housing and may be installed into the housing 106. Another embodiment of the stop ring 108 may include multiple arc-shaped pieces adapted to form a partial ring of less than the inner circumference of the housing and installed within the housing 106. These embodiments are exemplary and are not exclusive of any other configuration that forms a protrusion or protrusions on the inner surface at or near the top of the housing 106 for the purpose of preventing the caddy 101 from being pulled out of the housing 106. In certain embodiments, the stop ring 108 may be installed into an annular groove in the inner surface of the housing 106, may be installed into a counter bore, or into a cutout located at the end of the housing 106 should the housing 106 be polygonal in shape In certain embodiments, the sides of the tool bits 109 in the open position may be supported upon an edge of the wall of the housing 106, may be supported upon an edge of a wall formed at the outer perimeter of the caddy base 102, or may be unsupported on their sides and held only at their bases by attraction to the magnets 110.

In certain embodiments, the caddy 101 may be biased to remain in the open position until a force is applied to push the caddy 101 towards the closed position, by a variety of means. This bias may include the sides of tilted tool bits 109 resting upon the housing 106 wall, a friction fit of an element of the caddy 101 within an element of the housing 106, a ball plunger device in the caddy 101 impinging upon the housing 106, a ball plunger device in the housing 106 impinging upon the caddy 101, an elastomeric ring or other elastomeric element compressed between the caddy 101 and the housing 106, a magnetic attraction between elements of the caddy 101 and housing 106, or the like.

In certain embodiments, the holding surfaces 122 may be implemented with an individual magnet 110 under each tool bit 109, a single larger magnet which provides magnetic holding surfaces under all tool bits 109, some other number of magnets 110 between one and the number of tool bits 109 able to be stored in the caddy 101, or the like.

In certain embodiments, which use fixed magnets 110 to hold the tool bits 109 to the caddy 101, the magnets 110 may be fixed by bonding to the caddy base 102, bonding into a hole or cavity in the caddy base 102, may be held mechanically by clamping, or the like.

In certain embodiments, caddies of the tool bit storage and retrieval device 100 may store tool bits 109 on multiple stacked levels. For example, a caddy 101 may store eight tool bits 109 on each of two levels, for total storage of 16 tool bits 109. The tool bit storage and retrieval device may also be multileveled and store a plurality of tool bits 109 on each level. As the caddy 101 is pulled out of the housing 106, each level of tool bits 109 may successively exit the housing 106 and tilt out to the accessible position. Likewise, one or more levels of tool bits 109 may tilt through openings in the housing 106 to transition into the accessible position.

In certain embodiments, the caddy 101 of the tool bit storage and retrieval device 100 may have a caddy cap 105 that remains outside of the housing 106 for grasping when the caddy 101 is in the closed position. Other embodiments may have an alternate surface the user may grasp to move the caddy 101, including, but not limited to, an element of the caddy 101 projecting through an opening in the walls of the housing 106, or is accessible through the bottom of the housing 106.

In certain embodiments, the caddy 101 of the tool bit storage and retrieval device 100 may have a cross sectional perimeter shape, sectioned perpendicular to the sliding axis of the caddy 101, that is circular, oval, polygonal, or any other shape. In certain embodiments of the tool bit storage and retrieval device 100 the shape of the exterior of the housing may be substantially cylindrical, any polygonal prism, a curved shape to fit to the hands of the user, or any other solid shape.

Referring now to FIGS. 10A through 19, a second preferred embodiment of the angled storage and retrieval device 1000 will now be described. Referring specifically to FIGS. 10A through 12B, the caddy 1020 may include a caddy base 1025 with a topside 1090 and a bottom side 1091, base surfaces 1027, magnets 1060, ribs 1026, recesses 1021, a hollow caddy axle 1024, and an engagement aperture 1022. The caddy base 1025 may be circular in shape or any other shape consistent with the interior of a housing 1010. The topside 1090 of the caddy base 1025 may include a base surface both within the confines of the hollow caddy axle 1024 as well as a surface outside the hollow caddy axle 1024. The portion of the topside 1090 of the caddy base 1025 located inside the hollow caddy axle 1024 is more specifically defined as the caddy base shoulder 1023.

The housing 1010 may be cylindrical, oval prism, ovoid prism, square prism, rectangular prism and polygonal prism or any other shape able to accommodate and slideably receive the caddy 1020. The housing 1010 may be enclosed at one end and open at another end to accommodate the caddy 1020 therein. The hollow caddy axle 1024 may be a hollow cylinder that extends from the caddy base 1025 to a caddy cap 1040. It may extend medially from the caddy base to the caddy cap 1040 and may be structured to receive an engagement member 1030 therein. The engagement aperture 1022 may be located at the center of the caddy 1020, concentric with the hollow caddy axle 1024 when viewed at an orientation along the central axis of the hollow caddy axle 1024. The engagement aperture 1022 may have a diameter smaller than the inner diameter of the hollow caddy axle 1024. The caddy base shoulder 1023 may be a platform located at the caddy base topside 1090 top within the hollow caddy axle 1024.

Figure 12A:
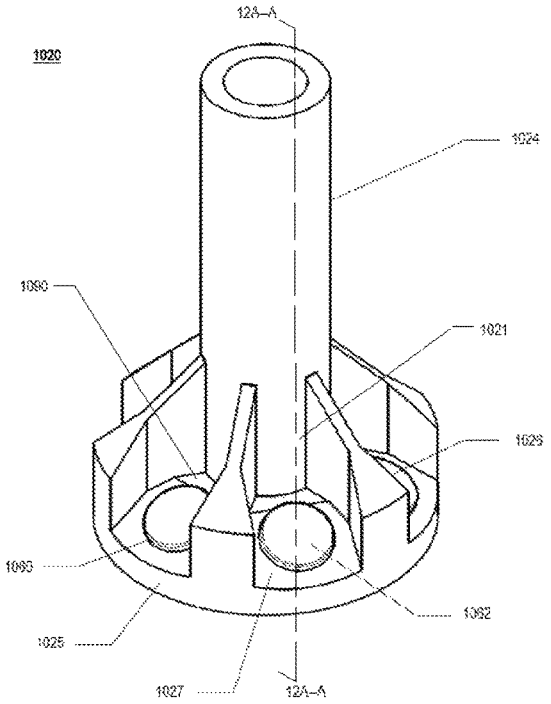
FIG. 12A is a side perspective view of a caddy of the tool bit storage and retrieval device illustrated in FIG. 10A.
Figure 12B:
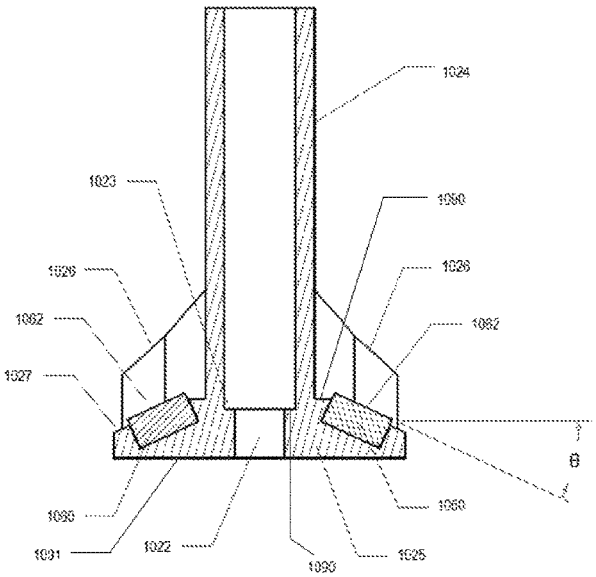
FIG. 12B is a cross sectioned side view of the caddy illustrated in FIG. 12A and taken through line 12A-A.

Referring now to FIGS. 12A and 12B, additional features of the caddy 1020 are described in greater detail. The base surfaces 1027 may extend from a location proximal to the hollow caddy axle 1024 to the outer perimeter of the caddy base 1025. The base surfaces 1027 may be oriented at an angle relative to the horizontal, where horizontal is defined as normal to the longitudinal axis of the caddy 1020. By way of non-limiting example, the depicted embodiment illustrates the base surfaces 1027 angled at 25 degrees, however, any angle capable of splaying the tool bits 109 away from a longitudinal axis of the caddy 1020 is within the scope of this application. For purposes of this application, longitudinal axis shall refer to extending in the direction of length. In this embodiment, the longitudinal axis of the caddy 1020 may be coincident with the axis of the hollow caddy axle 1024.

The magnets 1060 may be affixed within bored holes, bored into base surfaces 1027 on the caddy base topside 1090 and may be structured to hold an end of the plurality of tool bits 109. The holding surface 1062 of the magnets 1060 may protrude above the base surface 1027 in which the magnet 1060 is mounted. In the depicted embodiment, the magnets 1060 are cylindrical. However, any shape that facilitates the magnets 1060 being affixed to the base surfaces 1027 to provide an angled platform for the plurality of tool bits 109 is contemplated to be within the scope herein. This includes, but is not limited to, any solid prism, wedge-shaped, stepped cylinder-shaped, truncated cone-shaped, or the like. In some embodiments, the magnets 1060 may be a plurality of magnets 1060 positioned around a topside 1090 of the caddy base 1025 and the base surfaces 1027. However, in other embodiments the caddy base 1025 itself may be formed as a single, monolithic magnet. Likewise, the caddy base 1025 may include a slanted base portion that itself is a single, monolithic magnet angled to splay the plurality of tool bits 109 away from the longitudinal axis of the caddy 1020 when the caddy 1020 is in the open position. The holding surfaces 1062 of magnets 1060 may be oriented so that they form greater than a 90-degree angle with axis of the hollow caddy axle 1024. This orientation is defined as facing away from the hollow caddy axle 1024. In the depicted embodiment, the base surfaces 1027 are slanted planar surfaces, however the base surfaces may be any shape or angle which allows magnets 1060 to be mounted such that the holding surface 1062 of the magnet is slanted away from the caddy center. Referring to FIG. 12B, the slant of the holding surface 1062 of the bit holding magnet 1060 forms an angle θ between the holding surface 1062 and a normal to the longitudinal axis of the caddy 1020. This angle may be approximately 25 degrees or any angle which facilitates easy access to the tool bits 109 greater than 0 degrees and less than 90 degrees. In some embodiments, the magnets 1060 may serve a dual purpose of attracting the plurality of tool bits 109 on the caddy base topside 1090 as well as propagating an attracting force through the bottom side 1091 of the caddy base 1025. As described hereinbelow, the attracting force propagated through the caddy base bottom side 1091 may be used in conjunction with an attractor member 1050 to bias the caddy 1020 in a closed position.

A series of ribs 1026 may connect to the caddy base 1025, extending distally therefrom to a height less than or equal to the height of hollow caddy axle 1024. The ribs 1026 may connect to the hollow caddy axle 1024 and extend radially in the direction of an outer circumference of the caddy base 1025. However, the ribs 1026 may extend from the hollow caddy axle 1024, the caddy base 1025, or both. The ribs 1026 may have a top surface which is slanted such that the rib 1026 is taller at the hollow caddy axle 1024 than at the outer circumference of the caddy 1020. However, in some embodiments, the ribs 1026 may not extend and connect with the outer circumference of the caddy 1020. Other embodiments may include the ribs 1026 extending and connecting with the outer circumference of the caddy 1020. The ribs 1026 may define recesses 1021 around the perimeter of the caddy 1020. The ribs 1026 may define the recesses 1021 as polygonal walled cavities configured to facilitate the placement of tool bits 109 therein. The ribs 1026 may be structured to separate the individual tool bits within the plurality of tool bits 109. In some embodiments, the ribs 1026 may be structured as columns that extend from the caddy cap 1040 to the caddy base 1025.

Referring now to FIGS. 15A, 15B, 11B, and 12B, a caddy cap 1040 may include a circular cap upper end 1048, a circular cap lower end 1046, an opening 1042, and a caddy cap shoulder surface 1044. However, any shape of the caddy cap 1040 is contemplated to be within the scope of this application including, but not limited to square, rectangular, oval, or polygonal. The caddy cap 1040 may conform to the shape of the housing 1010 so as to enclose it when the caddy 1020 is oriented in the closed position. Opening 1042 may be cylindrical in shape and located at the center of the underside of cap lower end 1046. Opening 1042 may be sized to accept the hollow caddy axle 1024 of the caddy 1020, allowing the caddy cap 1040 and caddy 1020 to be assembled together. Assembly may be permanent using chemical bonding or some other permanent joining technique, or removable using a press fit or snap fit or other removable assembly technique. The height of the hollow caddy axle 1024 of the caddy 1020 and the depth of the opening 1042 of caddy cap 1040 may be configured such that when caddy cap 1040 is assembled to hollow caddy axle 1024, there is sufficient axial space below the caddy cap 1040 and above the magnets 1060 to fit standard length tool bits 109 in an upright position. The cap upper end 1048 of caddy cap 1040 may have an outer diameter substantially similar to the outer diameter of housing 1010. The cap lower end 1046 of caddy cap 1040 may have an outer diameter which is smaller than the outer diameter of 1048, and also smaller than the inner diameter of housing 1010. Caddy cap shoulder surface 1044 may be located at the bottom of cap upper end 1048, circumscribing cap lower end 1046.

Figure 13A:
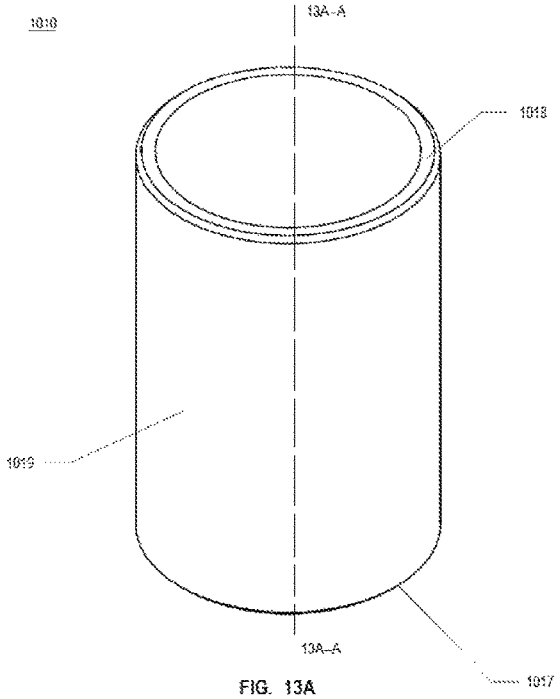
FIG. 13A is a side perspective view of a housing of the tool bit storage and retrieval device illustrated in FIG. 10A.
Figure 13B:
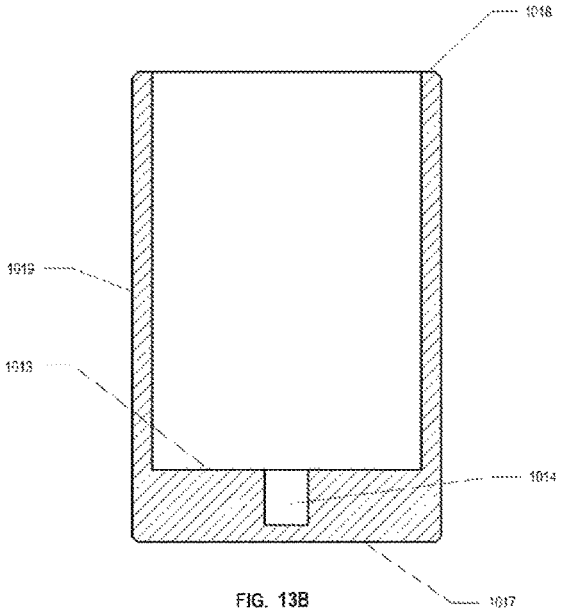
FIG. 13B is a cross-sectioned side view of the housing illustrated in FIG. 13A and taken through line 13A-A.
Figure 14A:
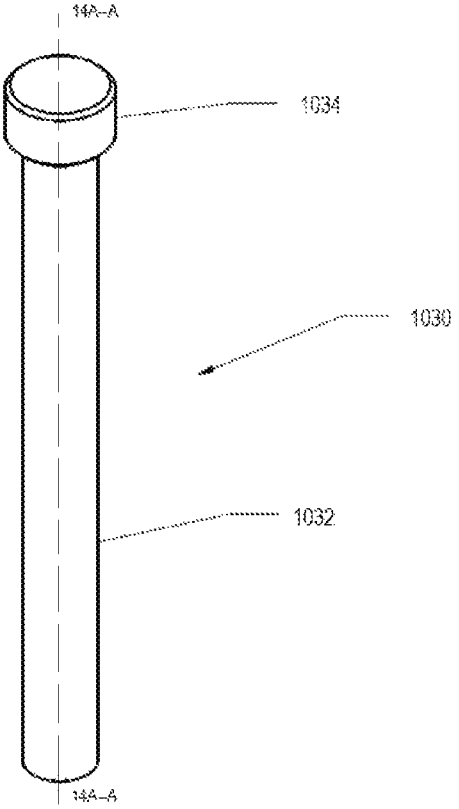
FIG. 14A is a side perspective view of an engagement member of the tool bit storage and retrieval device illustrated in FIG. 10A.
Figure 14B:
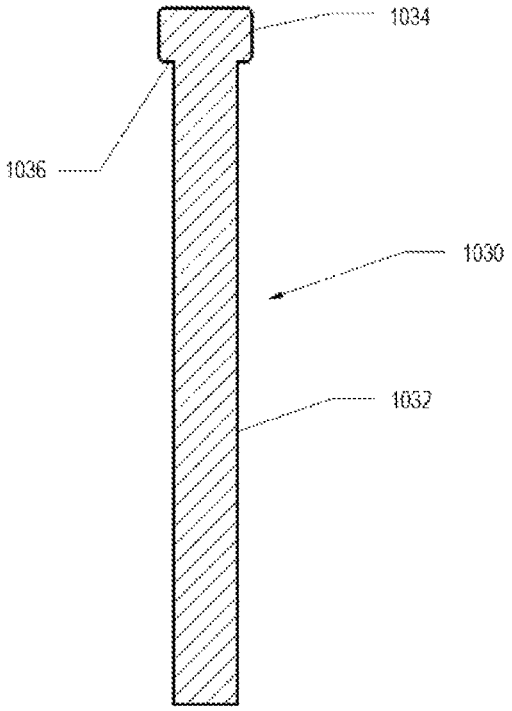
FIG. 14B is a cross-sectioned side view of the engagement member illustrated in FIG. 14A and taken through line 14A-A.
Figure 15A:
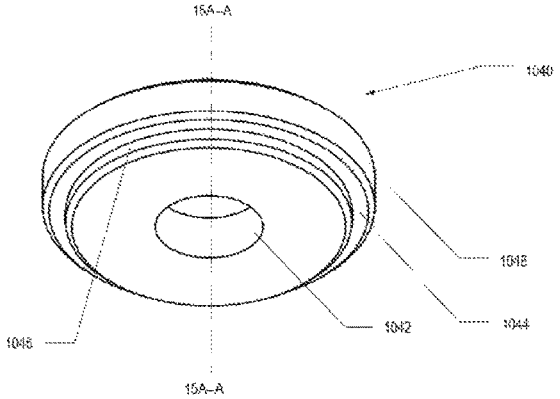
FIG. 15A is a lower perspective view of a caddy cap of the tool bit storage and retrieval device illustrated in FIG. 10A.
Figure 15B:
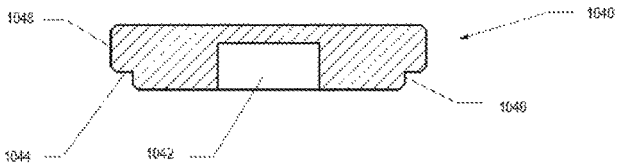
FIG. 15B is a cross-sectioned side view of the caddy cap illustrated in FIG. 15A and taken through line 15A-A.
Figure 16:
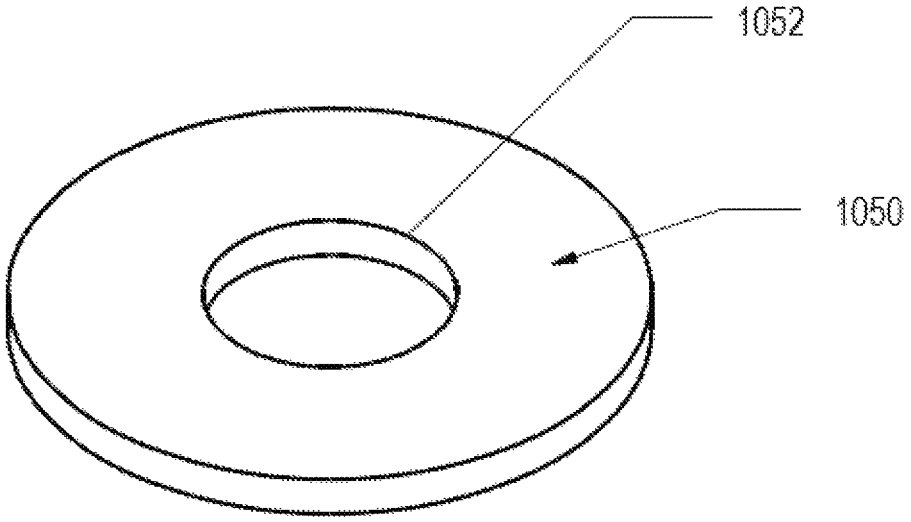
FIG. 16 is a side perspective view of an attractor member of the tool bit storage and retrieval device illustrated in FIG. 10A.

Referring now additionally to FIGS. 13A and 13B, the tool bit storage and retrieval device 1000 may include a housing 1010. The housing 1010 may be cylindrical in shape with a hollow interior. The housing may include a first end defined as the housing bottom 1017, a second end defined as the housing top 1018, and a housing body 1019 located medially there between. The housing top 1018 may be a cross-sectioned circular aperture defined as an open end. The housing 1010 may include a housing interior bottom 1013, and a circular hole 1014 located at the center of the housing interior bottom 1013. The housing interior bottom 1013 may be an enclosed end of the housing located opposite an open end of the housing 1010.

Referring now to FIGS. 10B, 11B, 12B, 13B, 14A and 14B, the tool bit storage and retrieval device 1000 may include an engagement member 1030. Engagement member 1030 may include a shaft first end, defined as a shaft head 1034 that is positioned atop a shaft body 1032. The engagement member 1030 may include a shoulder surface 1036 below the shaft head 1034. The diameter of the shaft head 1034 may be larger than the diameter of the shaft body 1032. The shaft body 1032 may be positioned through the engagement aperture 1022 and structured to slide the caddy 1020 within the housing 1010 between limits provided by the shaft head 1034 and the caddy cap 1040. These limits may enable the caddy 1020 to be in a fully open position when the shaft head 1034 is in contact with the caddy base topside 1090. The limits also enable the caddy 1020 to be in a closed position when the caddy cap 1040 is in contact with the housing top 1018.

Shoulder surface 1036 may be located on the underside of shaft head 1034, circumscribing shaft body 1032. Shaft body 1032 of engagement member 1030 may be affixed to a portion of the housing 1010. In some embodiments, this may be an enclosed end of the housing 1010. In some embodiments, the shaft body 1032 of engagement member 1030 may be assembled into circular hole 1014 at the housing interior bottom 1013 of the hollow interior of the housing 1010. The engagement member may be affixed to the housing 1010 by any known means in the art including chemical bonding or some other permanent joining technique. It may be removably affixed using a press fit, snap fit, or may utilize a male threaded engagement member 1030 into a female threaded hole in the housing 1010, or any other removable assembly technique. The diameter of shaft body 1032 may be smaller than the diameter of an engagement aperture 1022 on caddy 1020, and the diameter of shaft head 1034 may be smaller than the inner diameter of hollow caddy axle 1024 on caddy 1020. The diameter of shaft head 1034 may be larger than the diameter of engagement aperture 1022 on caddy 1020. Prior to assembly of engagement member 1030 into housing 1010, engagement member 1030 may be assembled into the hollow caddy axle 1024 of caddy 1020, such that the shaft body 1032 slides within the engagement aperture 1022, and the shaft head 1034 slides within the inside of hollow caddy axle 1024. Caddy cap 1040 may then be assembled onto hollow caddy axle 1024 of caddy 1020. With the engagement member 1030 assembled into the caddy 1020 and then into the housing 1010, the caddy 1020 may be able to slide along its longitudinal axis distal to the housing along engagement member 1030 until the shaft head 1034 comes in contact with the caddy base topside 1090. This orients the caddy 1020 in the open position. Furthermore, with the caddy cap 1040 assembled onto the caddy 1020, the caddy 1020 may be able to slide along its longitudinal axis into the housing until the caddy cap shoulder surface 1044 comes to rest on the housing top 1018. This describes the caddy in the closed position.

Referring now to FIGS. 10B, 11B, 14A and 16, the tool bit storage and retrieval device 1000 may include an attractor member 1050. The attractor member 1050 may include a circular center hole 1052. The diameter of center hole 1052 may be larger than the outer diameter of shaft body 1032, so that shaft body 1032 of the engagement member 1030 can pass through the center hole 1052 of attractor member 1050. The attractor member 1050 may be assembled into the housing interior bottom 1013 of the hollow interior of the housing 1010. In the depicted embodiment, the attractor member 1050 may be attached directly to the housing interior bottom 1013 of the housing 1010 using chemical bonding or another suitable method for joining abutting planar surfaces. In other embodiments, the attractor member 1050 may attach to the housing 1010 with mechanical clamping such as with a threaded fastener, or by press fit or chemical bonding of the attractor member 1050 into a recess formed in the housing interior bottom 1013 of the hollow interior of housing 1010. Other embodiments may attach the attractor member 1050 to engagement member 1030 with a press fit or chemical bonding or mechanical clamping such as with a threaded fastener. In other embodiments, a ring-shaped shoulder on engagement member 1030 which is larger than the diameter of center hole 1052 of attractor member 1050 may clamp the attractor member 1050 to the housing interior bottom 1013 of the hollow interior of the housing 1010 when the engagement member 1030 is assembled into housing 1010. The attractor member 1050 may be constructed of steel or another ferromagnetic material so that the attractor member 1050 is attracted to magnets. In some embodiments, the attractor member 1050 itself may be a magnet.

Referring now to FIGS. 11A, 11B, 13A, 13B, 15A and 15B the device is described in more detail. The housing top 1018 of the housing 1010 may serve as a seat for the caddy cap shoulder surface 1044 of caddy cap 1040, preventing the caddy cap 1040 from being inserted into the housing 1010. The cap lower end 1046 of the caddy cap 1040 may project inside the housing 1010, providing radial support of the caddy cap 1040 against the opening of the housing 1010. The caddy cap 1040 may be constructed to be grasped by a user's hand and adapted to facilitate the sliding of the housing 1010 relative to the caddy 1020. This transitions the tool bit storage and retrieval device 1000 between open and closed positions. In some embodiments, the caddy cap 1040 may be knurled around its outer surfaces to enhance grip. In certain embodiments, the caddy 1020 may be movable or rotate relative to a fixed housing 1010, or some or all of the housing 1010 may be movable or rotate relative to a fixed caddy 1020. In certain embodiments, when in the open position the tool bits 109 may tilt over the housing top 1018 or may tilt through an opening or a plurality of openings in the housing 1010.

Figure 11A:
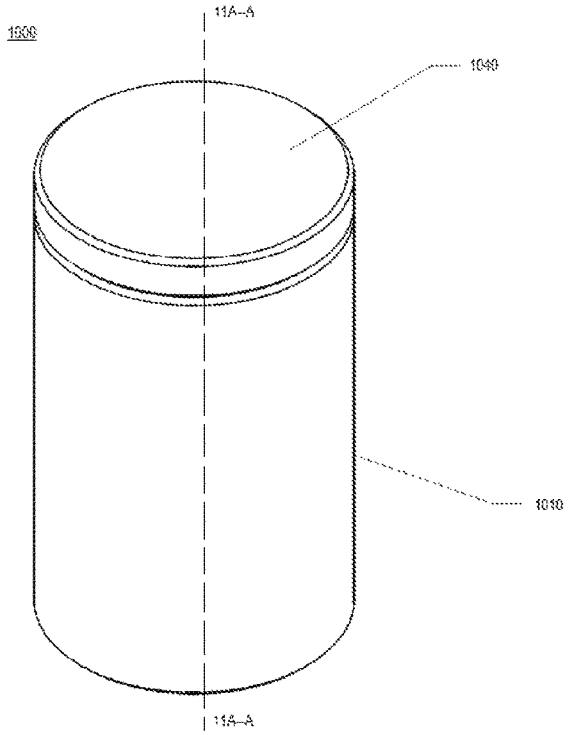
FIG. 11A is a side perspective view of the tool bit storage and retrieval device illustrated in FIG. 10A, in a closed position.
Figure 11B:
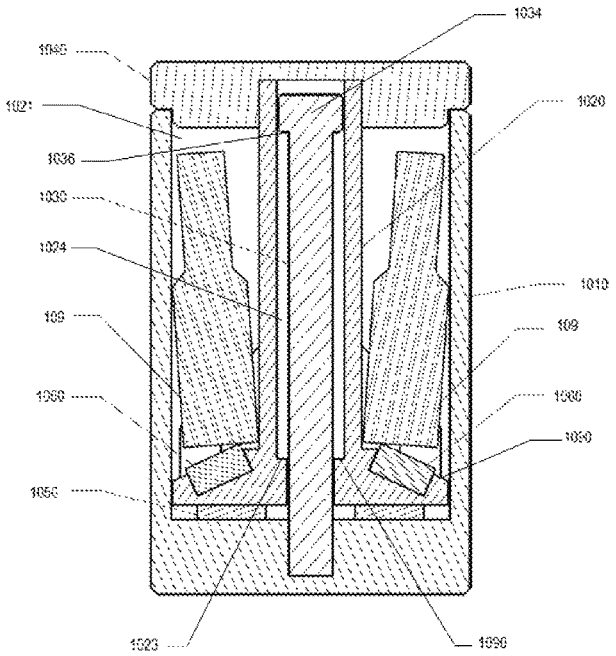
FIG. 11B is a cross sectioned side view of the tool bit storage and retrieval device illustrated in FIG. 11A and taken through line 11A-A.

Referring now to FIGS. 11B, 12A and 12B. When in the closed position, the tool bits 109 may be constrained by the interior of the housing 1010 and aligned within recesses 1021 substantially parallel to the hollow caddy axle 1024. As depicted in FIG. 11B, the tool bits 109 may lean against the interior wall of housing 1010 away from hollow caddy axle 1024 due to attraction of the tool bits 109 to the holding surfaces 1062 of magnets 1060. This slight lean may characterize the substantially parallel posture of the plurality of tool bits 109 relative to the hollow caddy axle 1024 when in the closed position. When the tool bit storage and retrieval device 1000 is in the closed position, the tool bits therein are in their stored position.

Figure 17:
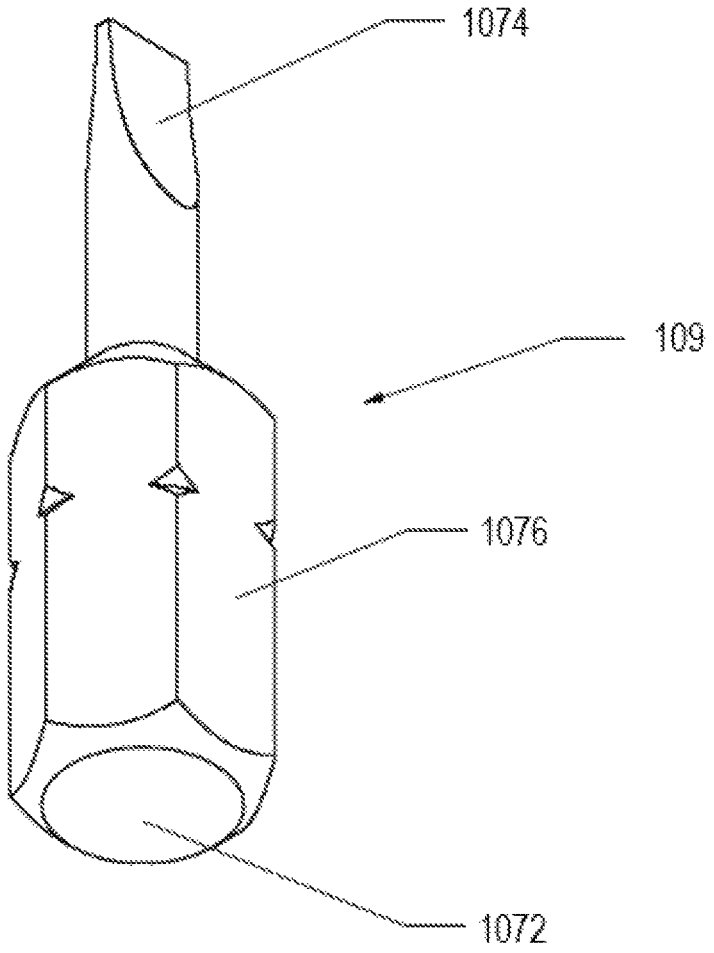
FIG. 17 PRIOR ART
FIG. 17 is a lower perspective view of a standard hexagonal tool bit stored within the tool bit storage and retrieval device illustrated in FIG. 10A according to the prior art.

As is known in the art and further illustrated in FIG. 17, a typical tool bit consists of a flat end 1072 that is configured to fit inside a tool, and a utility end 1074 that is used to facilitate the turning of a fastener. By way of non-limiting example, a fastener may include a screw or the like. When in the stored position, the flat end 1072 of the tool bit 109 may be angled away from the holding surface 1062 of the magnet 1060 so as not to lie parallel with the holding surface 1062 of the magnet 1060. In some instances, the flat end 1072 of the tool bit 109 may rest upon the upper edge of the holding surface 1062 of the magnet 1060. This may be a result of the constraining force of the interior walls of the housing 1010 overcoming the magnetic force between the holding surface 1062 of the magnet 1060 and the flat end 1072 that would otherwise leave the two aligned and angled away from the hollow caddy axle 1024 and the longitudinal axis of the caddy 1020.

Figure 10A:
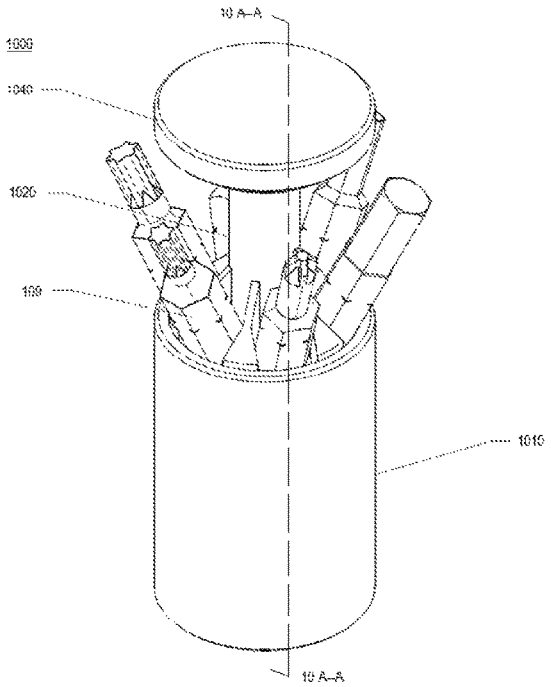
FIG. 10A is a side perspective view of a tool bit storage and retrieval device in an open position according to an embodiment of the present invention.
Figure 10B:
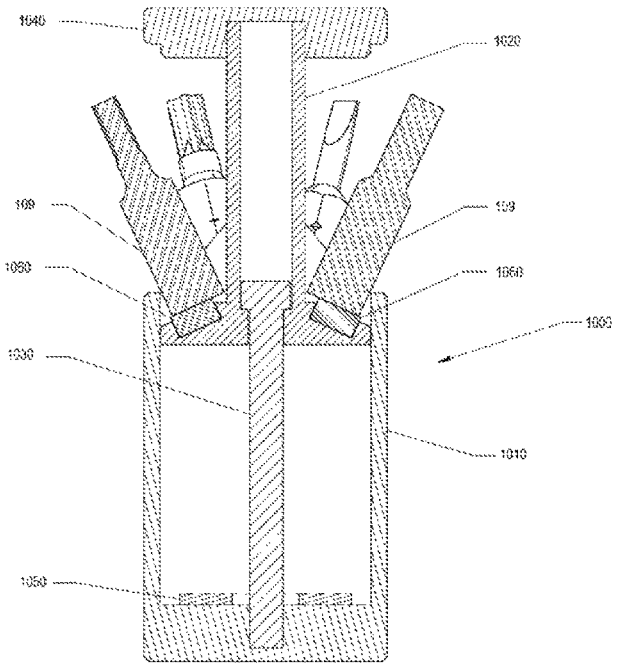
FIG. 10B is a cross sectioned side view of the tool bit storage and retrieval device illustrated in FIG. 10A and taken through line 10A-A.

Referring to FIGS. 10A, 10B, and 11B the tool bit storage and retrieval device 1000 positioned in the open position is shown. As shown, a caddy 1020 may slide along the longitudinal axis of an engagement member 1030. The caddy 1020 may slide partially out of the housing 1010 so that the engagement member 1030 shoulder surface 1036 may contact the caddy base shoulder 1023. In this position, the interior walls of the housing 1010 may not constrain the tool bits 109 in the stored position, thereby allowing magnetic attraction to position the flat ends 1072 of the tool bits 109 to align substantially parallel with the holding surfaces 1062 of the magnets 1060. When the flat end 1072 of the tool bit 109 is aligned substantially parallel with the holding surface 1062 of the magnet 1060, the tool bits 109 may be splayed away from the hollow caddy axle 1024 at an angle configured to facilitate a user's removal of the tool bits 109 from the caddy 1020. Likewise, each bit holding magnet 1060 and recess 1021 may be spaced at a distance around the circumference of the caddy base 1025 so as to facilitate a user's ability to remove or replace a tool bit 109 without interference from another tool bit 109 within the caddy 1020.

When the tool bit storage and retrieval device 1000 is in the closed position, the attractor member 1050 may be in close proximity along the longitudinal axis to the bottom of caddy 1020, and in close proximity to the magnets 1060. Therefore, the attractor member 1050 may be positioned anywhere in magnetic communication with the bottom side 1091 of the caddy base 1025. The attractor member 1050 may be affixed or moveably attached to the housing 1010 and/or the engagement member 1030. The caddy 1020 may thereby be biased to remain in the closed position by the attractive force of the bit storage magnets 1060 to the attractor member 1050.

The tool bit storage and retrieval device 1000 may be operated by a user grasping the caddy cap 1040 with a first hand and grasping the housing body 1019 with a second hand. The tool bit storage and retrieval device 1000 may be transitioned from a closed position into an open position when a user pulls the caddy cap 1040 in a direction opposite the housing body 1019. A user may utilize a pulling force sufficient to overcome the attractive force between the magnets 1060 and the attractor member 1050. As the caddy cap 1040 and the caddy 1020 slide along the longitudinal axis of the engagement member 1030 distal to the housing body 1019 the constraining force of the housing body 1019 against the tool bit 109 may be removed and the flat end 1072 of the tool bit 109 may begin to align substantially parallel with the holding surface 1062 of the bit holding magnet 1060. When the caddy base shoulder 1023 reaches the shoulder surface 1036 the caddy 1020 has reached the upper limit of travel out of the housing 1010, and the tool bit storage and retrieval device 1000 is in the open position.

When in the open position, the tool bits 109 may be splayed around the hollow caddy axle 1024 so that the utility end 1074 of the tool bits 109 may be angled away from the hollow caddy axle 1024 in a manner configured to facilitate the removal and replacement of the tool bits 109 therein. A user wishing to store a tool bit 109 within the caddy 1020 may place the flat end 1072 of the tool bit 109 onto the holding surface 1062 of the bit holding magnet 1060, which may allow the attractive force of the bit holding magnet 1060 to hold the tool bit 109 in place. A user wishing to retrieve a tool bit 109 from the tool bit storage and retrieval device 1000 may grasp the tool bit 109 and remove it with enough force to overcome the magnetic attraction between the flat end 1072 of the tool bit 109 and the holding surface 1062 of the magnet 1060.

When the tool bit storage and retrieval device 100 is in a first position, defined as the open position, the splayed tool bits 109 may be biased to remain in the splayed position by attraction of the flat ends 1072 of the tool bits 109 towards the holding surfaces 1062 of the magnets 1060. In this orientation, the sides of the tool bits 109 may be leveraged against the upper portion of the housing 1010 thereby biasing the tool bit storage and retrieval device 1000 to the open position. It may in turn be biased to remain in the open position until acted upon by enough outside force to overcome the magnetic force splaying the tool bits 109. This outside force may cause the sides of the splayed tool bits 109 to engage the inner edge of the housing top 1018 of the housing 1010 and retract. The tool bit storage and retrieval device 100 may be transitioned from the open position to a closed position when a user pushes the caddy cap 1040 with a first hand toward the housing body 1019 grasped by a second hand. The force of the user sliding the two components in this manner may overcome the magnetic attraction of the flat end 1072 of the tool bit 109 towards the holding surface 1062 of the magnet 1060. This motion may begin to move the tool bits 109 into the housing 1010 in a manner so as to align them substantially parallel to the hollow caddy axle 1024. When the caddy cap shoulder surface 1044 reaches the housing top 1018 and abuts thereto, the contact of the housing top 1018 against the caddy cap shoulder surface 1044 may prevent the caddy 1020 from sliding any further and the tool bit storage and retrieval device 1000 may come to rest in a second position, which may be defined as the closed position. When in the closed position, the posture of the plurality of tool bits 109 may be restricted by the interior of the housing 1010 which is structured to store the plurality of tool bits therein. The tool bits 109 may be aligned substantially parallel with the hollow caddy axle 1024. However, when in the closed position, the plurality of tool bits 109 may lean against the interior of the housing 1010 since they are biased by the holding surface 1062 of the magnets 1060 towards the splayed position relative to the longitudinal axis of the caddy 1020. When in the closed position, the tool bit storage and retrieval device 1000 may allow the tool bits 109 to be stored and transported easily.

Figure 18:
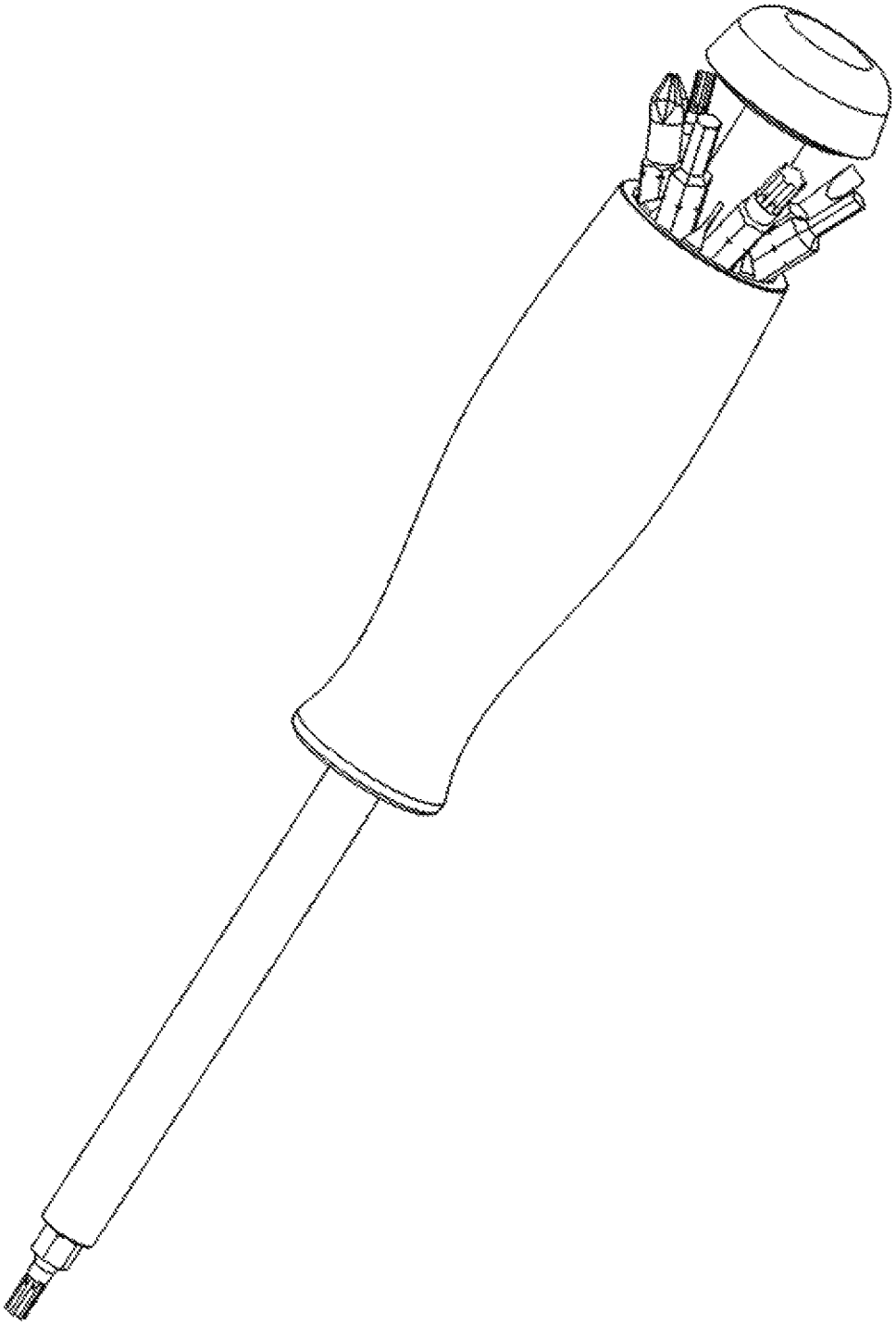
FIG. 18 is a perspective view of a tool bit storage and retrieval device integrally formed with a screwdriver handle.
Figure 19:
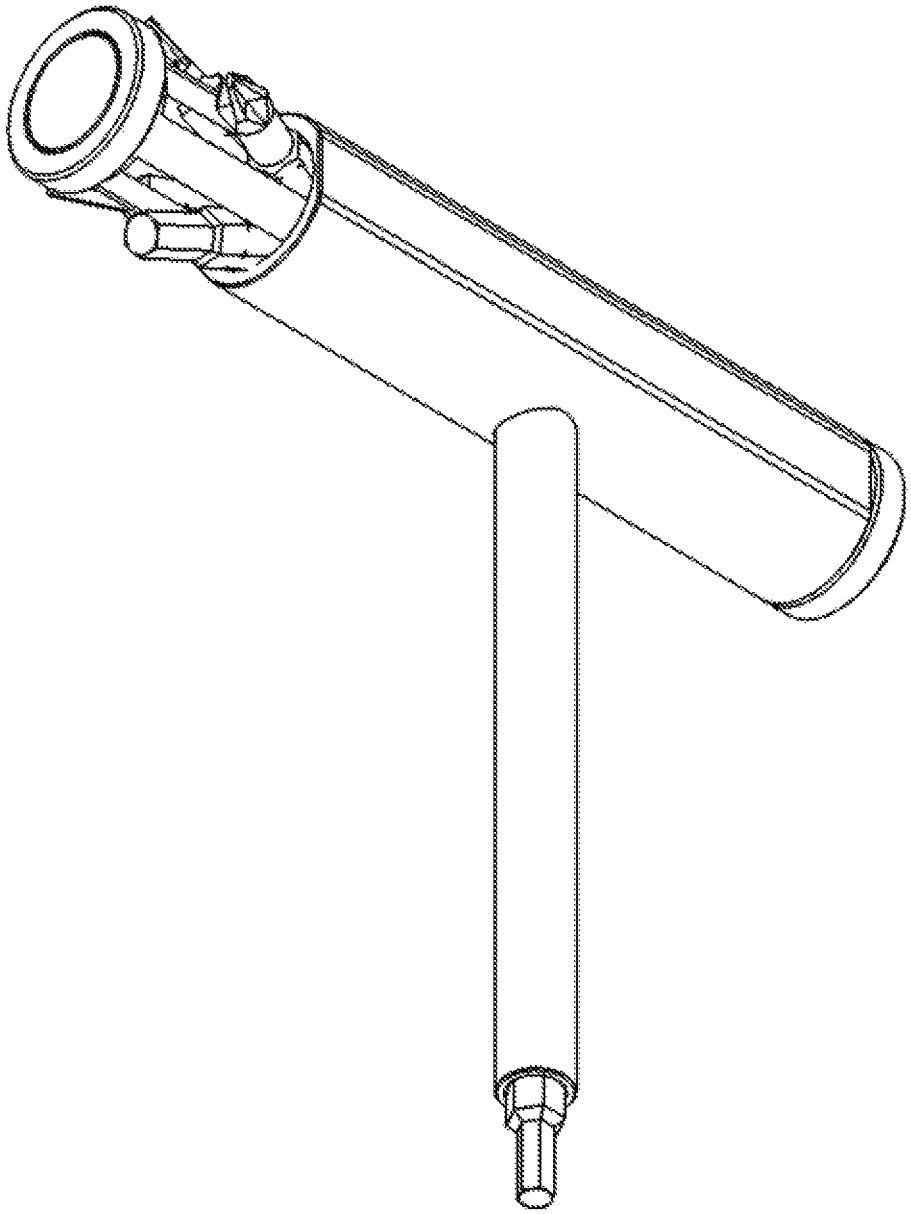
FIG. 19 is a perspective view of a tool bit storage and retrieval device integrally formed with a handle of a t-handled driver, with one portion in an open position and one portion in a closed position according to an embodiment of the present invention.

In one embodiment, the tool bit storage and retrieval device 1000 may be integrated into a screwdriver handle as depicted in FIG. 18. In such an embodiment, the caddy cap 1040 may be located at the end of the screwdriver handle distal the portion of the screwdriver adapted to interact with a screw and the caddy 1020 may slide distal to the screwdriver handle. Another embodiment may include the tool bit storage and retrieval device 1000 integrated into one or both ends of the handle of a T-handled driver as depicted in FIG. 19. In such an embodiment, a plurality of tool bits 109 may be stored in each a first and/or a second end of the handle. The tool bit storage and retrieval device 1000 at each of the first and second end of the handle may be operated independently. Other embodiments may include the tool bit storage and retrieval device 1000 into the body of a power tool or a tool box or into the handle or body of any hand tool.

In certain embodiments, a device may be provided to bias the caddy 1020 of the tool bit storage and retrieval device 1000 to the closed position. In such an embodiment, to operate, the user may grasp the caddy cap 1040 and pull with a force exceeding a threshold force exerted by the biasing device in order to place the caddy 1020 in a first position, which may be defined as an open position. In the depicted embodiments, the biasing device is the attractor member 1050, attracted to the magnets 1060 as described previously. In other embodiments, the attractor member 1050 may include, but is not limited to, a magnet, which may be affixed to the underside of the caddy cap 1040 and attracted to the top of engagement member 1030. The biasing device may alternatively include a magnet affixed to the caddy 1020 and attracted to another magnet or metallic element fixed within the housing 1010 when the caddy 1020 is in the closed position. The biasing device may alternatively include a magnet affixed to housing 1010 and attracted to a metallic element affixed to caddy 1020 when caddy 1020 is in the closed position. The biasing device may alternatively include a friction fit of a part of the caddy 1020 located within the housing 1010 when the caddy 1020 is in the closed position. The biasing device may also be a snap fit of a part of the caddy 1020 within the housing 1010 when the caddy 1020 is in the closed position.

In the depicted embodiments, the caddy 1020 is free to rotate within the housing 1010 of the tool bit storage and retrieval device 1000. In certain embodiments, a device may be provided to prevent rotation of the caddy 1020 within the housing 1010. This may be accomplished in a number of ways, including, but not limited to, a tongue in the caddy 1020 engaging a groove in the housing 1010. The rotation prevention device may include a slot cut in the wall of the housing 1010 into which an element fixed to and protruding from the caddy 1020 may fit within. The rotation prevention device may include a caddy 1020 and housing 1010 both having corresponding polygonal perimeters to prevent relative translation between the caddy 1020 and the housing 1010. The rotation prevention device may include a caddy cap 1040 polygonal in shape engaging a like-shaped recess at the top of the caddy 1020 housing 1010. The rotation prevention device may include a single projection or a plurality of projections extending distally from the caddy cap 1040 engaging a recess at the top of the housing 1010. The rotation prevention device may include a projection extending distally from the housing 1010 engaging a recess in the proximate side of the caddy cap 1040. The rotation prevention device may include a radial projection from the caddy cap 1040 engaging a recess in the housing 1010.

In certain embodiments, the caddy cap 1040 may be recessed into the housing 1010 when the caddy 1020 is in the closed position. In such an embodiment, an alternate means for grasping the caddy cap 1040 may be provided for the user to extend the caddy 1020 distally from the housing 1010. For example, there may be a push latch whereby the caddy cap 1040 may be pushed into the housing 1010 to latch the tool bit storage and retrieval device 1000 in the closed position. In order to place the tool bit storage and retrieval device 1000 in the open position, the caddy cap 1040 may then be pushed again to be released whereby a spring biases the tool bit storage and retrieval device 1000 to the open and extended position. Another embodiment may demonstrate a portion of the caddy 1020 extending through a slot or cavity in the housing 1010, which may be configured to facilitate a user grasping and moving the caddy 1020 between the open and closed positions. Another embodiment may demonstrate an element protruding from the top of caddy cap 1040 which may be configured to facilitate a user grasping and moving the caddy 1020 between the open and closed positions.

In certain embodiments, tool bits 109 may be stored in recesses 1021 around the perimeter of the hollow caddy axle 1024. Other embodiments may include a single recess that spans the entire circumference of the hollow caddy axle 1024 with no separation between tool bits 109. In certain embodiments, individual recesses may be fully separated from each other by solid walls, or the recesses may be largely open to adjacent recesses, with only a partial wall separating the recesses.

The tool bit storage and retrieval device 1000 may be made of plastic or metal or composites or a combination of plastics and/or metals and or composites, or of any other suitable material known in the art. In certain embodiments, the tool bit storage and retrieval device 1000 may be manufactured using injection molding, die casting, machining, extruding, additive manufacturing, or any other suitable method of manufacturing.

The distance that the caddy 1020 may be extended distally from the housing 1010 may be limited by one or more embodiments. In the depicted embodiments, this limit is reached when the shoulder surface 1036 comes into contact with caddy base shoulder 1023. This is also described more generally as the shaft head 1034 coming into contact with the caddy base topside 1090. Another embodiment may include a stop ring around the top inner circumference of the housing 1010 with an inner diameter less than the outer diameter of some part of the caddy 1020, preventing that part of the caddy 1020 from moving distally from the housing beyond the stop ring. There also may be an element protruding from the inner surface of the housing 1010 contacting some element of the caddy 1020 and preventing the caddy 1020 moving beyond the point of contact. Another embodiment may include a groove or slot cut into or through the wall of the housing 1010, into which a protruding element of the caddy 1020 may be inserted, preventing movement of that protruding element of caddy 1020 beyond the termination of the groove or slot. Yet another embodiment may include a flexible tether attached to the bottom of the caddy 1020 and to the housing 1010 preventing the caddy 1020 from moving beyond the point where the tether is fully extended.

In certain embodiments, the sides of the tool bits 109 in the open position may be supported upon an edge of the wall of the housing 1010, may be supported upon an edge of a wall formed at the outer perimeter of the caddy 1020, or may be unsupported on their sides and held only at their bases by attraction to the magnets 1060.

In certain embodiments, the caddy 1020 may be biased to remain in the open position until a force is applied to push the caddy 1020 towards the closed position, by a variety of means. This bias may include the sides of tilted tool bits 109 resting upon the housing 1010 wall, a friction fit or a snap fit of an element of the caddy 1020 on an element of engagement member 1030, a friction fit or a snap fit of an element of the caddy 1020 within an element of the housing 1010, a ball plunger device in the caddy 1020 impinging upon the housing 1010, a ball plunger device in the housing 1010 impinging upon the caddy 1020, an elastomeric ring or other elastomeric element compressed between the caddy 1020 and the housing 1010, a magnetic attraction between elements of the caddy 1020 and housing 1010, or the like.

In certain embodiments, the holding surfaces 1062 may be implemented with an individual magnet 1060 under each tool bit 109, a single larger magnet which provides magnetic holding surfaces 1062 under all tool bits 109, another number of magnets 1060 between one and the number of tool bits 109 able to be stored in the caddy 1020, or the like.

In certain embodiments, the magnetic surfaces which hold the tool bits 109 to the caddy 1020 may be implemented using one or more fixed magnets 1060, or may be implemented using one or more magnets 1060 attached to the caddy 1020 with a hinge. The hinge may allow each magnet 1060 to tilt between an upright position where tool bits 109 are upright when seated against the flat surface of the magnets 1060 to a tilted position where tool bits 109 are tilted outwards when seated against the flat surface of the magnets 1060.

In certain embodiments, which use fixed magnets 1060 to hold the tool bits 109 to the caddy 1020, the magnets 1060 may be fixed by bonding to the caddy base 1025, bonding into a hole or cavity in the caddy base 1025, may be held mechanically by clamping, or the like. Furthermore, in other embodiments, at least one magnet 1060 may be positioned in a manner to hold the tool bits 109 at their midsection, defined here as the shanks 1076. In this embodiment, the tool bits 109 may be stored within the caddy 1020 on or around the hollow caddy axle 1024 and the tool bits 109 may or may not splay in this particular embodiment.

In certain embodiments, caddies of the tool bit storage and retrieval device 1000 may store tool bits 109 on multiple stacked levels. For example, a caddy 1020 may store eight tool bits 109 on each of two levels, for total storage of 16 tool bits 109. The tool bit storage and retrieval device may also be multileveled and store a plurality of tool bits 109 on each level. As the caddy 1020 is pulled out of the housing 1010, each level of tool bits 109 may successively exit the housing 1010 and splay out to the accessible position. Likewise, one or more levels of tool bits 109 may splay through openings in the housing 1010 to transition into the accessible position.

In certain embodiments, the caddy 1020 of the tool bit storage and retrieval device 100 may have a caddy cap 1040 that remains outside of the housing 1010 for grasping when the caddy 1020 is in the closed position. Other embodiments may have an alternate surface that the user may grasp to move the caddy 1020. This may include, but may not be limited to, an element of the caddy 1020 projecting through an opening in the walls of the housing 1010, or being accessible through the bottom of the housing 1010.

In certain embodiments, the caddy 1020 of the tool bit storage and retrieval device 1000 may have a cross sectional perimeter shape, sectioned perpendicular to the sliding axis of the caddy 1020, that is circular, oval, polygonal, or any other shape. In certain embodiments of the tool bit storage and retrieval device 1000 the shape of the exterior of the housing 1010 may be substantially cylindrical, any polygonal prism, a curved shape to fit to the hands of the user, or any other prism shape.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus, the scope of the invention should be determined by the appended claims and their legal equivalents, and not by the examples given.

That which is claimed is:

1. A tool bit storage and retrieval device comprising:

a housing;

a caddy configured to slideably engage an interior of the housing and to removeably receive a plurality of tool bits; and at least one magnet affixed to the caddy and configured to attract the plurality of tool bits, each at least one magnet including an angled holding surface facing away from a longitudinal axis of the caddy;

wherein the caddy is moveable between an open position and a closed position;

wherein the closed position is defined by the caddy being substantially contained by the housing;

wherein the open position is defined by the caddy being translated outwardly from the housing;

wherein the plurality of tool bits are in a first position when the caddy is in the open position, and a second position when the caddy is in the closed position;

wherein, when the caddy is in the open position and the plurality of tool bits are in the first position, a flat surface of each of the plurality of tool bits is attracted to the angled holding surface of one of the at least one magnet, and the tool bits are biased to be splayed away from the caddy longitudinal axis at an angle configured to facilitate a user's removal of the tool bits from the caddy.

2. The tool bit storage and retrieval device according to claim 1 wherein the second position of the plurality of tool bits is defined as one in which a posture of the plurality of tool bits is restricted by the interior of the housing inward toward alignment with the caddy longitudinal axis, and the plurality of tool bits are configured to be stored in the interior of the housing.

3. The tool bit storage and retrieval device according to claim 1 wherein the tool bit storage and retrieval device is integrally formed with at least a portion of a tool configured to be operable with a tool bit.

4. The tool bit storage and retrieval device according to claim 1 wherein the tool bit storage and retrieval device is integrally formed with one of a handle of a t-handle driver and a handle of a screwdriver.

5. The tool bit storage and retrieval device according to claim 1 wherein the at least one magnet is a plurality of magnets positioned around a topside of a base of the caddy.

6. The tool bit storage and retrieval device according to claim 5 wherein the plurality of magnets is positioned within a plurality of bores on the topside of the caddy base.

* * * * *